US006322481B1

(12) United States Patent
Krull

(10) Patent No.: US 6,322,481 B1
(45) Date of Patent: Nov. 27, 2001

(54) ADJUSTABLE WEIGHT EXERCISE METHODS AND APPARATUS

(76) Inventor: Mark A. Krull, 1705 E. Ridge Ct., Northfield, MN (US) 55057

( * ) Notice: Subject to any disclaimer, the term of this patent is extended or adjusted under 35 U.S.C. 154(b) by 0 days.

(21) Appl. No.: 09/290,144

(22) Filed: Apr. 13, 1999

Related U.S. Application Data

(63) Continuation-in-part of application No. 09/020,119, filed on Feb. 6, 1998, now Pat. No. 6,099,442.
(60) Provisional application No. 60/108,768, filed on Nov. 17, 1998.

(51) Int. Cl.[7] ..... A63B 21/075
(52) U.S. Cl. ..... 482/107; 482/106; 482/108
(58) Field of Search ..... 482/50, 93, 106–108; D21/681

(56) References Cited

U.S. PATENT DOCUMENTS

| | | | | |
|---|---|---|---|---|
| 4,529,198 | | 7/1985 | Hettick, Jr. | 272/123 |
| 4,822,034 | | 4/1989 | Shields | 272/123 |
| 5,284,463 | | 2/1994 | Shields | 482/107 |
| 5,344,375 | | 9/1994 | Cooper | 482/106 |
| 5,637,064 | | 6/1997 | Olson et al. | 482/108 |
| 5,769,762 | | 6/1998 | Towley, III | 482/93 |
| 5,839,997 | | 11/1998 | Roth | 482/107 |
| 5,879,274 | | 3/1999 | Mattox | 482/107 |
| 6,033,350 | * | 3/2000 | Krull | 482/107 |
| 6,099,442 | * | 8/2000 | Krull | 482/107 |

* cited by examiner

*Primary Examiner*—John Mulcahy

(57) ABSTRACT

An exercise dumbbell includes a handle and weight plates maintained in spaced relationship relative thereto. At least one latch is movable into and out of engagement with a desired amount of weight to prevent movement of the engaged weight plates in a first direction, and thereby secure same relative to the handle. At least one catch is connected to the at least one latch and operable in a second, discrete direction to encourage the latch to remain engaged with the weight plates.

20 Claims, 32 Drawing Sheets

200
268
218
214
267
213
212
220
217
210
211
218

200
268
220
210
267
216
213
219

267
268
217
260
200
210

200
260
245
240a
210

240a
200
217
260
240b
210

FIG. 17
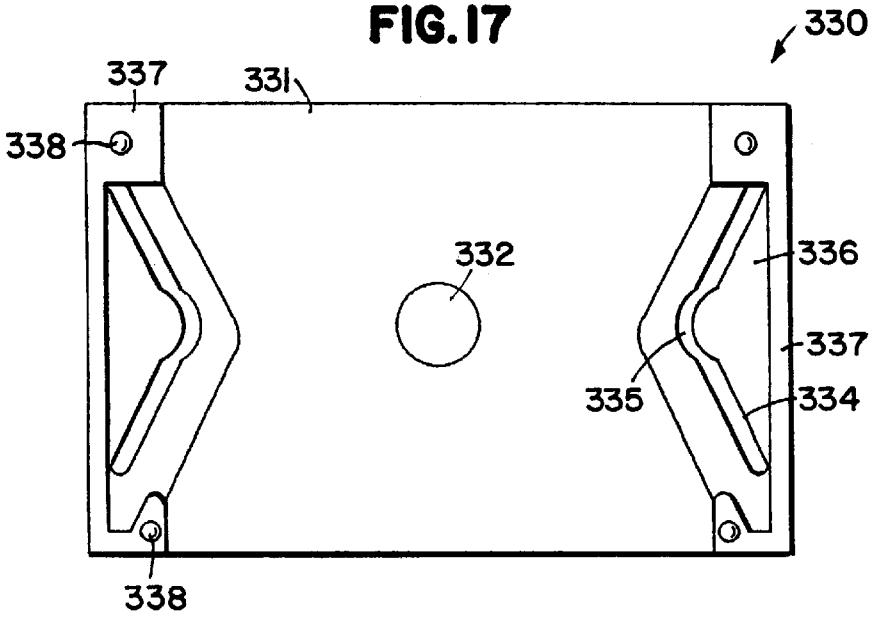
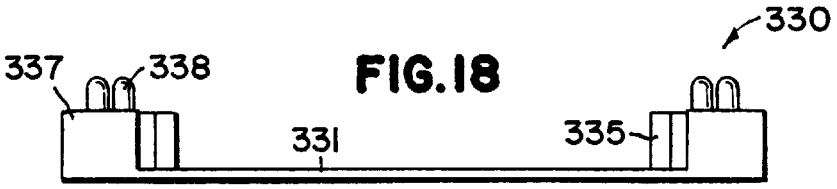
FIG. 18
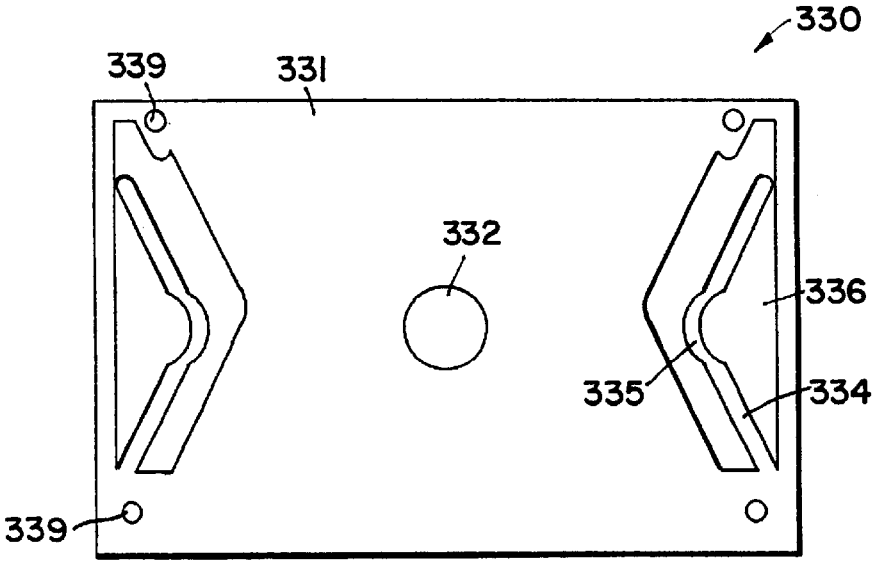
FIG. 19

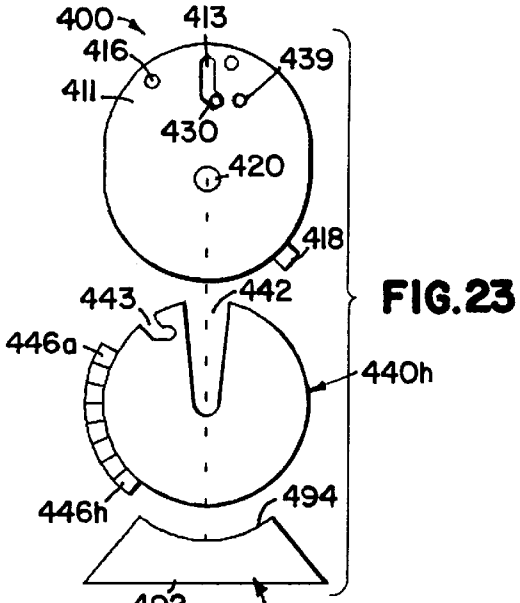
FIG.23
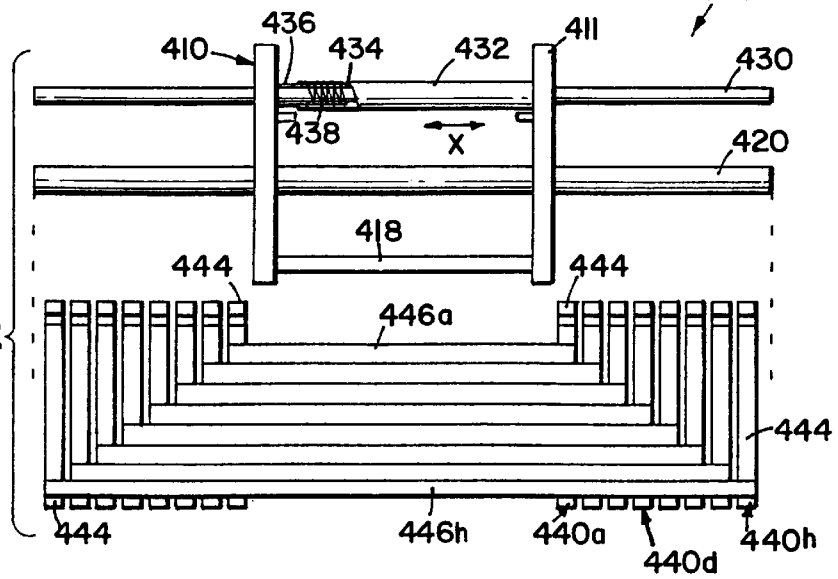
FIG.22
FIG.25
FIG.24

Fig. 33
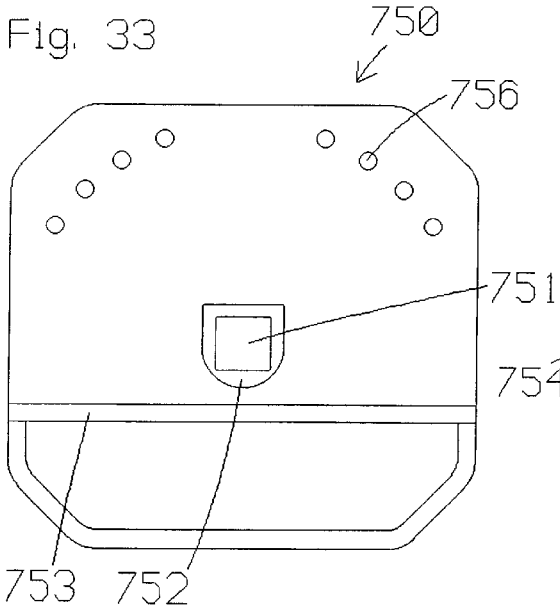
Fig. 32
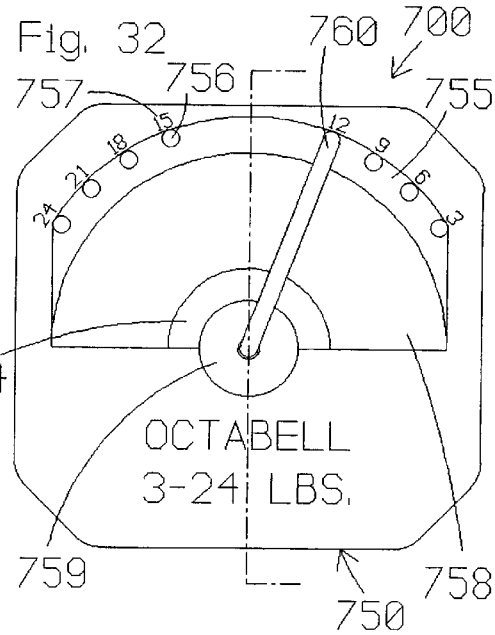
Fig. 37
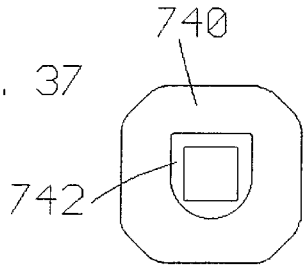
Fig. 38
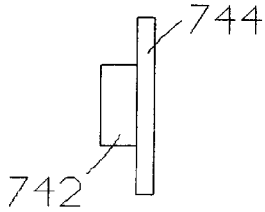
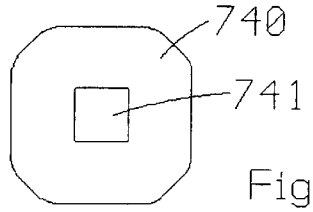
Fig. 39
Fig. 36
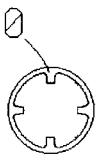
Fig. 35
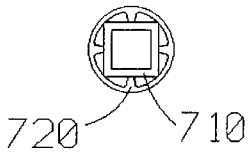
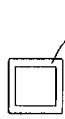
Fig. 34

Fig. 47
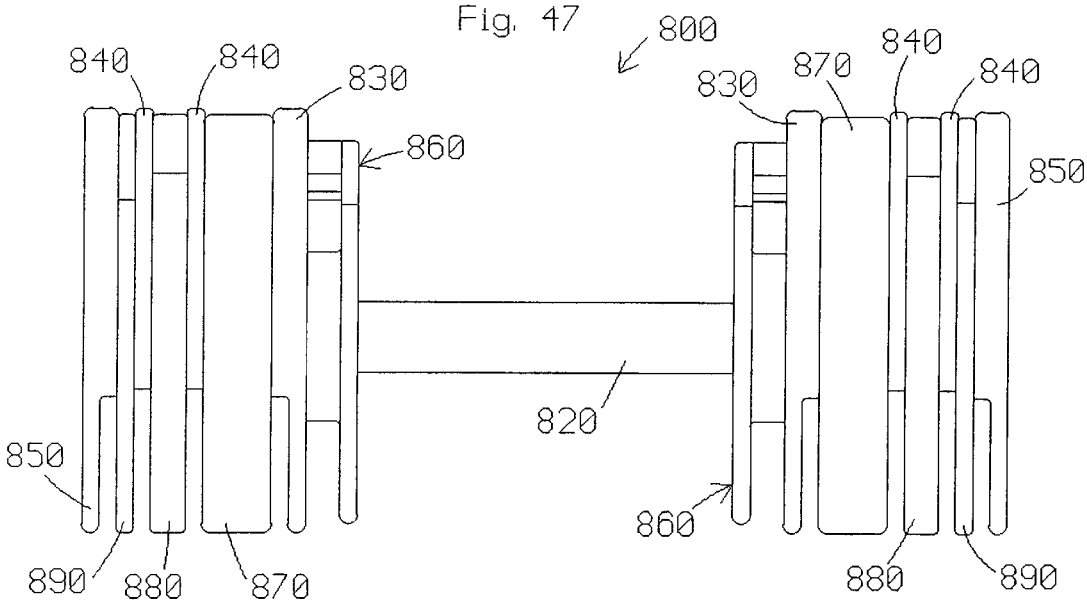
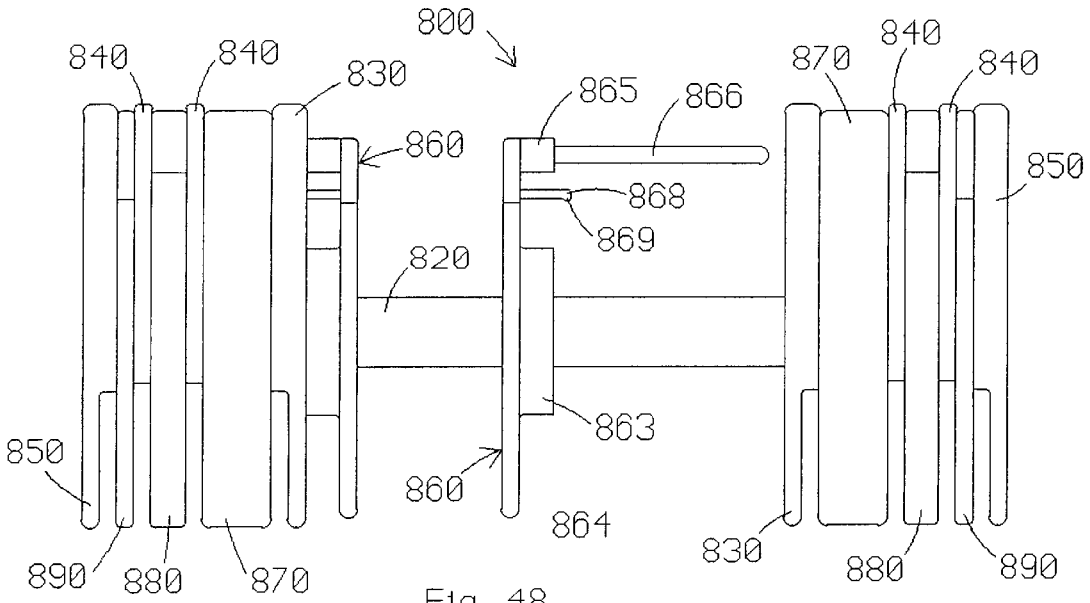
Fig. 48

ADJUSTABLE WEIGHT EXERCISE METHODS AND APPARATUS

CROSS-REFERENCE TO RELATED APPLICATIONS

This application is a continuation-in-part of U.S. patent application Ser. No. 09/020,119, filed on Feb. 6, 1998, now U.S. Pat. No. 6,099,442; and also discloses subject matter entitled to the filing date of U.S. Provisional Application Serial No. 60/108,768, filed on Nov. 17, 1998.

FIELD OF THE INVENTION

The present invention relates to exercise equipment and more particularly, to methods and apparatus for adjusting weight resistance to exercise.

BACKGROUND OF THE INVENTION

An object of the present invention is to provide improved apparatus and/or methods for adjusting resistance to exercise.

SUMMARY OF THE INVENTION

The present invention provides methods and apparatus which facilitate exercise involving the movement of weights subject to gravitational force. Generally speaking, the present invention allows a person to adjust weight resistance by latching a desired number of weights relative to a movable member and/or securing a desired amount of weight on opposite ends of a base member. The present invention may be applied to exercise weight stacks and/or free weight assemblies such as dumbbells and barbells.

A preferred dumbbell embodiment of the present invention may be described in terms of a handle; weights disposed on opposite ends of the handle and maintained in spaced relationship relative thereto; at least one latch movable into and out of engagement with the weights to prevent movement of the engaged weights relative to the handle; and means for accommodating rearrangement of the latch and/or the weights relative to one another in order to engage a different number and/or combination of weights. Many of the features and advantages of the present invention will become apparent to those skilled in the art from the more detailed description that follows.

BRIEF DESCRIPTION OF THE FIGURES OF THE DRAWINGS

With reference to the Figures of the Drawing, wherein like numerals represent like parts and assemblies throughout the several views.

FIG. 17 is an end view of one of the weight supports on the dumbbell of FIG. 14;

FIG. 18 is a bottom view of the weight support of FIG. 17;

FIG. 19 is an opposite end view of the weight support of FIG. 17;

FIG. 22 is a front view of a fourth exercise dumbbell constructed according to the principles of the present invention, shown in an operative configuration with no discretionary weights connected to the handle assembly;

FIG. 23 is an end view of the dumbbell of FIG. 22, shown relative to an underlying base;

FIG. 24 is a front view of the dumbbell of FIG. 22, shown in a first selective configuration;

FIG. 25 is an end view of the dumbbell of FIG. 22, shown in a second selective configuration and relative to the underlying base first shown in FIG. 23;

FIG. 32 is an end view of the dumbbell of FIG. 31;

FIG. 33 is an opposite end view of an end wall on the dumbbell of FIG. 31;

FIG. 34 is an end view of a bar on the dumbbell of FIG. 31;

FIG. 35 is an end view of a handle grip segment on the bar of FIG. 34;

FIG. 36 is an end view of the handle grip member of FIG. 35 apart from the bar of FIG. 34;

FIG. 37 is an end view of a spacer on the dumbbell of FIG. 31;

FIG. 38 is a side view of the spacer of FIG. 37;

FIG. 39 is an opposite end view of the spacer of FIG. 37;

FIG. 47 is a side view of an alternative embodiment dumbbell constructed according to the principles of the present invention;

FIG. 48 is a side view of the dumbbell of FIG. 47, with a weight selector member moved to a disengaged position;

DETAILED DESCRIPTION OF A PREFERRED EMBODIMENT

For purposes of discussion, the present invention is described with reference to exercise dumbbells. However, those skilled in the art will recognize that one or more features and/or combination of features which are disclosed herein with reference to dumbbells may also be applied to other exercise equipment, including weight stack machines, for example. Some examples of reciprocal applications are disclosed in U.S. patent application Ser. No. 08/939,845, filed on Sep. 29, 1997, and incorporated herein by reference to same.

Figure 31:
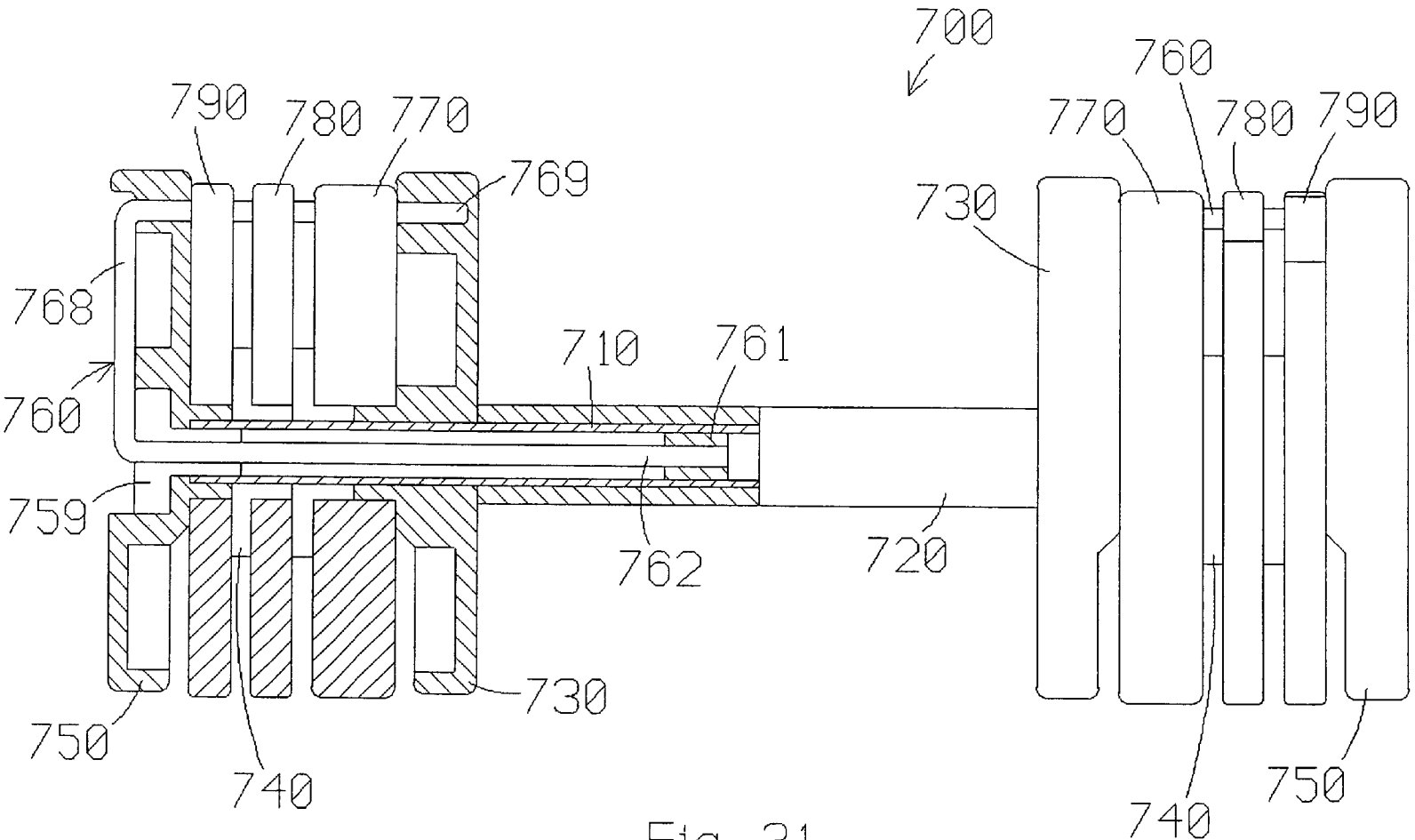
FIG. 31 is a partially sectioned side view of a preferred embodiment dumbbell constructed according to the principles of the present invention.

A preferred embodiment dumbbell constructed according to the principles of the present invention is designated as 700 in FIGS. 31–32. As shown in FIGS. 31 and 34, the dumbbell 700 includes a bar 710 which is preferably a square tube made of steel. As shown in FIGS. 31 and 36, the dumbbell 700 also includes a handle grip member 720 which is preferably a cylindrical tube made of plastic. As shown in FIG. 35, the bar 710 and the handle grip member 720 are sized and configured so that the former fits snugly inside the latter, and the parts are secured against rotation relative to one another.

Interior supports or plates 730 are mounted on the bar 710 outside each end of the handle grip member 720. Each support 730 provides a smooth inwardly facing surface which abuts an end of the handle grip member 720, and an irregular outwardly facing surface which is discussed in greater detail below.

Two spacers 740 are mounted on each end of the bar 710, outward from a respective interior support 730. As shown in FIGS. 37–39, each spacer 740 includes an axially extending offset 742 and a radially extending plate 744. A hole 741, sized and configured to receive the bar 710, extends through both portions of the spacer 740. Each spacer 740 is oriented so the offset 742 extends inward, toward the handle grip member 720.

Exterior supports or plates 750 are mounted on opposite ends of the bar 710, outside respective spacers 740. As shown in FIG. 33, most of the inwardly facing side of each support 750 is smooth. However, an axially extending offset 752 extends inward from each support 750 and abuts the plate portion 744 of a respective spacer 740. Also, for reasons discussed below, a lower portion of the inwardly facing side is recessed, and a beveled or ramped surface 753 is provided between the upper and lower portions.

As shown in FIG. 32, the lower half of the outwardly facing side of each support 750 is smooth (and well suited for bearing information about the product 700 and/or its manufacturer). The upper half of the outwardly facing side includes recessed surfaces 754 and 755, which are separated by a more deeply recessed surface 758.

Circumferentially spaced holes 756 are formed through each support 750 proximate the outermost edge of the recessed surface 755. A visual indicator is provided proximate each of the holes 756 for reasons discussed below. Both a hole and a depression are provided in the center of each support 750 to accommodate an end fastener 759. A shaft on the fastener 759 is anchored inside a respective end of the bar 710, and a head on the fastener 759 overlies a portion of a respective support 750.

Selector rods 760 have first ends 762 which are inserted through respective fasteners 759 and into respective ends of the bar 710. The rods 760 are selectively movable in both rotational and telescoping fashion relative to the bar 710. Cylindrical bushings 761 are connected to the ends 762 of respective rods 760 and bear against the inside walls of the bar 710. From a manufacturing perspective, the selector rods 760 are inserted through respective fasteners 759 and connected to respective bushings 761 before the fasteners 759 are secured to the bar 710.

An intermediate portion 768 of each selector rod 760 extends perpendicular to the first end 762 thereof (radially relative to the longitudinal axis of the bar 710). The intermediate portion 768 spans the surfaces 754, 758 and 755 on the outwardly facing side of a respective exterior support 750. Each support 750 is configured so that a respective intermediate portion 768 may rest outward from the surfaces 754 and 755 but inside an outermost surface defined by the support 750. Also, the recessed surface 758 allows a person to maneuver one or more fingers behind the intermediate portion (or handle portion) 768 in order to pull the selector rod 760 axially outward.

A second end 769 of each selector rod extends parallel to a respective first end 762 (axially relative to the longitudinal axis of the bar 710). The second end 769 aligns with any of the holes 756 in the exterior support 750 and has a beveled tip to facilitate insertion therein. Aligned openings are provided in each of the interior supports 730 to similarly receive the second ends 769 of a respective selector rod 760. Since the second end 769 is relatively shorter than the first end 762, the former may be pulled from the exterior support 750 and reoriented relative to same, while a portion of the latter remains inside the tube 710. As a result, the second end 769 may be inserted into any of the holes 756 at the discretion of the user.

The selector rods 760 may be biased relative to the tube 710 and/or one another, to remain in axially inward positions relative to the tube 710 and/or to resist axially outward movement. Some examples of suitable biasing arrangements are shown in FIGS. 79–89 and described below.

Figure 79:
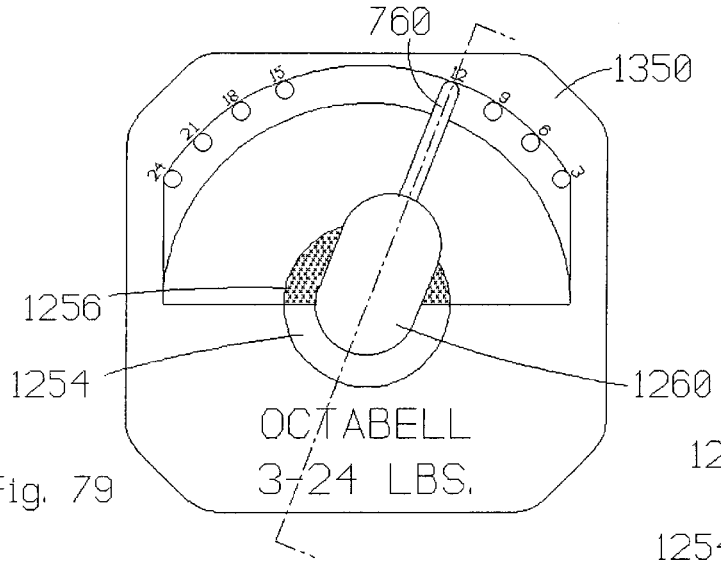
FIG. 79 is an end view of a biasing arrangement suitable for use in accordance with the present invention.
Figure 80:
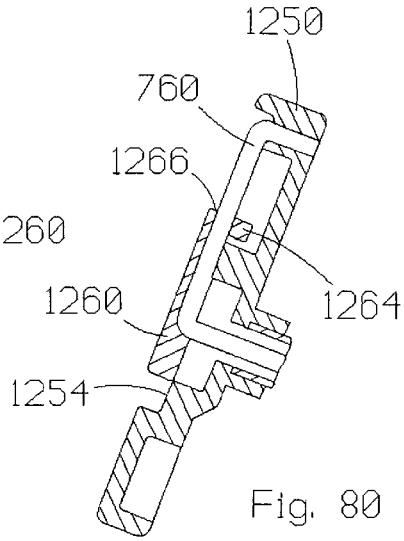
FIG. 80 is a sectioned side view of the biasing arrangement of FIG. 79.

FIGS. 79–80 show an end plate or support 1250 which is similar to the support 750 on the preferred embodiment 700. However, a relatively larger recessed surface 1254 is provided on the support 1250, and loop type fasteners 1256 are mounted on at least a portion of the surface 1254. Also, a cover 1260 is mounted on the selector rod 760 and overlies at least a portion of the surface 1254. In this regard, an opening 1266 is provided in a flange 1264 on the cover 1260 in order to receive and/or retain the selector rod 760. On this particular arrangement, hook type fasteners are mounted on the cover 1260 to mate with the loop type fasteners 1256 on the support 1250. The hook and loop type fasteners cooperate to discourage movement of the selector rod 760 axially away from the support 1250. The hook and loop type fasteners may be replaced by other suitable connecting means, such as a magnet, for example.

Figure 81:
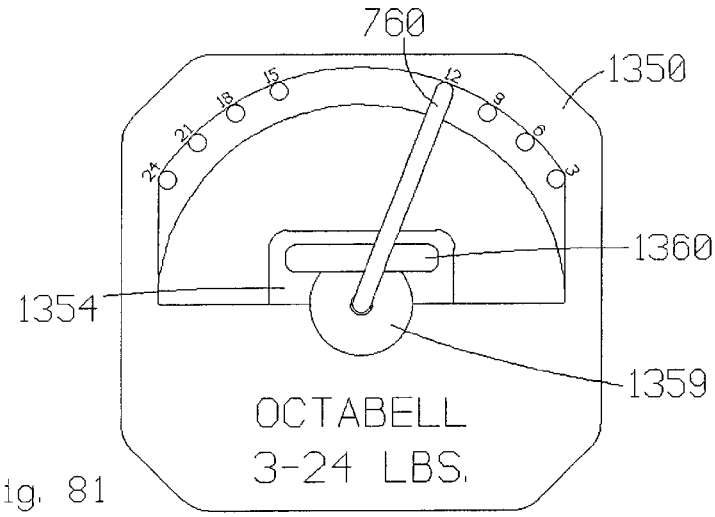
FIG. 81 is an end view of another biasing arrangement suitable for use in accordance with the present invention.

FIG. 81 shows an end plate or support 1350 which is similar to the support 750 on the preferred embodiment 700. However, a different recessed surface 1354 on the support 1350 cooperates with a distinct end fastener 1359 to accommodate a magnet 1360. The magnet 1360 is sized and situated to span the selector rod 760 regardless of the latter's orientation relative to the support 1350. The magnet 1360 cooperates with the steel selector rod 760 to discourage movement of the latter axially away from the support 1350.

Figure 82:
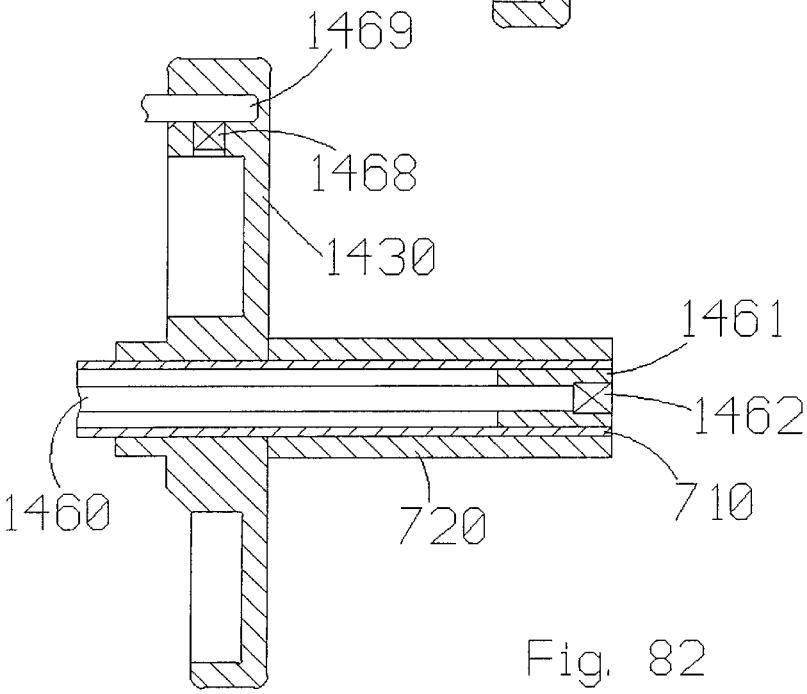
FIG. 82 is a sectioned side view of additional biasing arrangements suitable for use in accordance with the present invention.

FIG. 82 shows two additional biasing arrangements with reference to an inside plate or support 1430 which is similar to the support 730 on the preferred embodiment 700. However, for one of the biasing arrangements, an arcuate cavity is provided in the support 1430 to receive and/or retain an arcuate strip of magnetic material 1468. The magnet 1468 cooperates with the distal end 1469 of the steel selector rod 1460 to discourage movement of the latter axially away from the middle of the handle 720. For the other biasing arrangement, a bushing 1461 is secured to the opposite end of the selector rod 1460, and a magnet 1462 is mounted on the bushing 1461. The lengths of the opposite end selector rods are such that the magnet 1462 on the depicted rod 1460 engages either a similar magnet or a steel plate on the other selector rod when both occupy their respective fully engaged positions. The magnetic attraction between the abutting ends of the selector rods discourages movement of either rod axially away from the middle of the handle 720 and/or the other rod. The magnets on the abutting ends of the selector rods may be replaced by other suitable connecting means, such as hook and loop fasteners, for example. Those skilled in the art will also recognize that the two arrangements shown in FIG. 82 may be used in combination or in the alternative.

Figure 83:
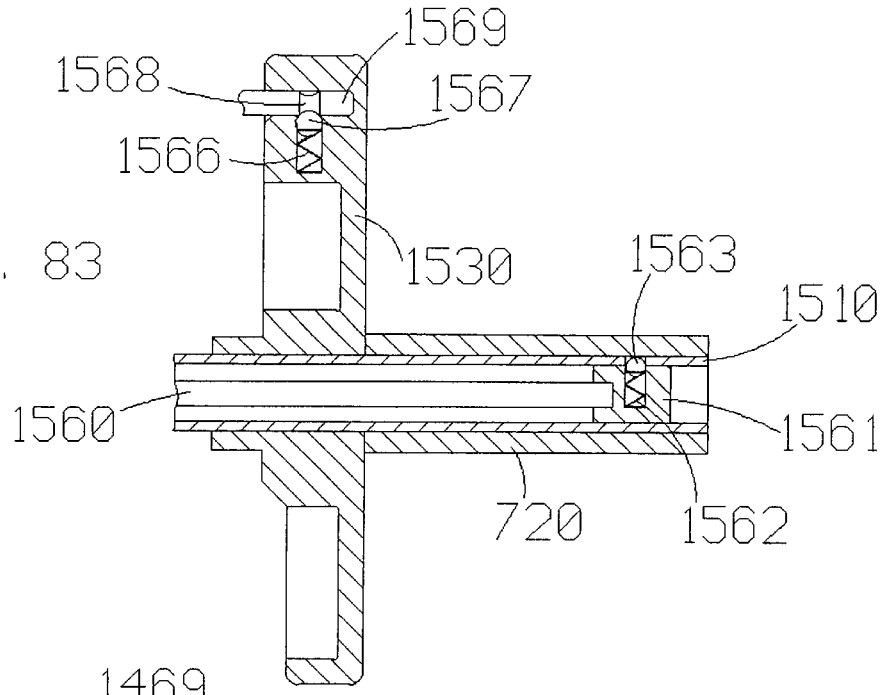
FIG. 83 is a sectioned side view of more biasing arrangements suitable for use in accordance with the present invention.

FIG. 83 shows two additional biasing arrangements which also may be used in combination or in the alternative. The arrangements are shown with reference to an inside plate or support 1530 which is similar to the support 730 on the preferred embodiment 700. However, for one of the biasing arrangements, an arcuate cavity is provided in the support 1530 to receive an arcuate rod 1567 having a circular cross-section. Relatively deeper cavities are provided in the support 1530, at spaced locations, to receive respective coil springs 1566. The springs 1566 bias the rod 1567 toward the top of the support 1530 and into an annular groove 1568 provided in the end 1569 of the selector rod 1560. The rod 1567 cooperates with the groove 1568 in the rod 1560 to discourage movement of the latter axially away from the middle of the handle 720.

For the other biasing arrangement, a bushing 1561 is secured to the opposite end of the selector rod 1460, and a cavity is provided in the bushing 1561 to receive both a coil spring 1562 and a ball 1563. The spring 1562 biases the ball 1563 toward the top of the support 1530 and into a hole provided in the tube 1510. The ball 1563 cooperates with the hole in the tube 1510 to discourage movement of the rod 1560 axially away from the middle of the handle 720.

Figure 85:
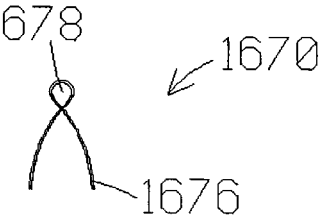
FIG. 85 is a front view of a clip suitable for use in conjunction with a selector rod shown in FIG. 84
Figure 84:
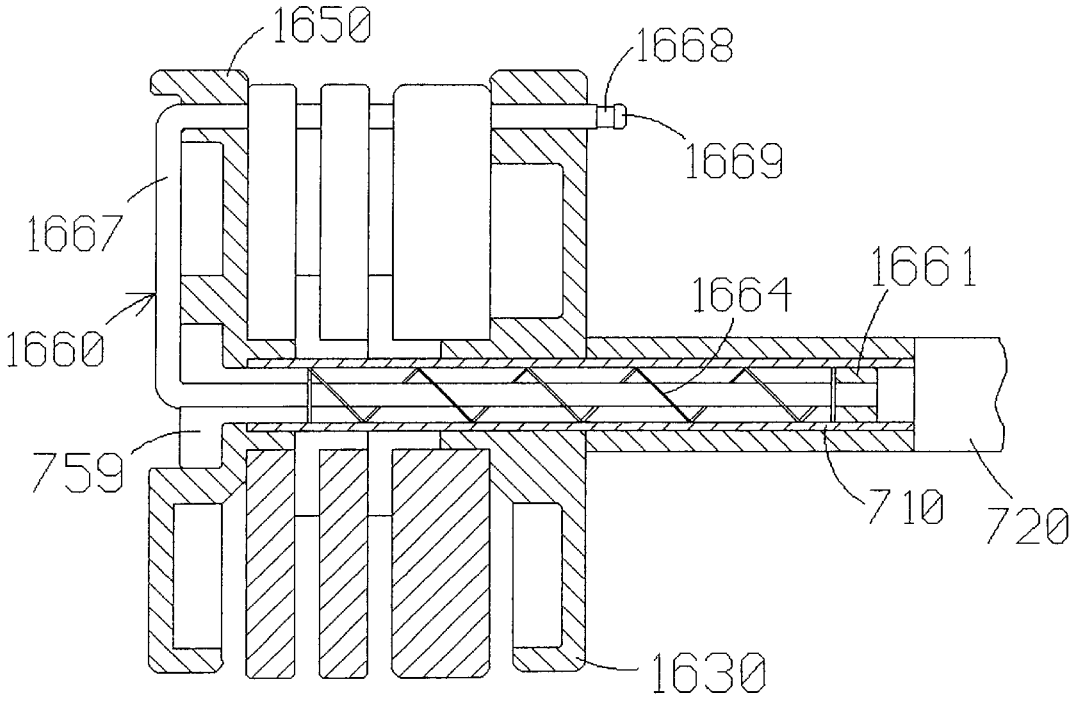
FIG. 84 is a sectioned side view of still more biasing arrangement suitable for use in accordance with the present invention.

FIGS. 84–85 shows two additional biasing arrangements suitable for use in accordance with the present invention. Among other things, FIG. 84 shows a selector rod 1660 extending through the end fastener 759 and having a first end anchored to a bushing 1661. The end fastener 759 is rigidly secured to the tube 710, and the bushing 1661 is slidably and rotatably mounted inside the tube 710. A coil spring 1664 is compressed between the bushing 1661 and the end fastener 759. The compression of the spring 1664 between the bushing 1661 and the end fastener 759 both discourages and resists movement of the selector rod 1660 axially away from the middle of the handle 720.

FIG. 84 also shows an interior plate or support 1630 having through holes aligned with the opposite end 1669 of the selector rod 1660. An annular groove 1668 is provided in the protruding end 1669 of the selector rod 1660 to facilitate mounting of a spring clip 1670 thereon. As shown in FIG. 85, the spring clip 1670 includes a circular intermediate portion 1678 sized and configured to occupy the groove 1668 in the absence of externally applied force. The spring clip 1670 also includes opposite end portions 1676 which may be squeezed together to enlarge the inside diameter of the intermediate portion 1678 to facilitate attachment and removal of the spring clip 1670 relative to the end 1669 of the selector rod 1660. When properly secured to the selector rod 1660, the spring clip 1670 discourages movement of the selector rod 1660 axially away from the middle of the handle 720.

Figure 87:
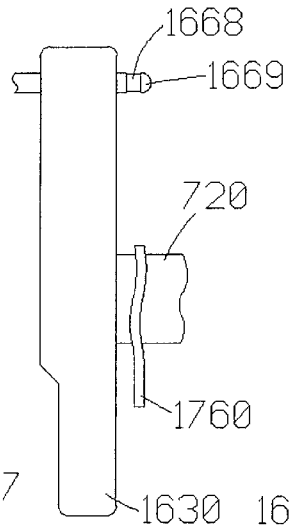
FIG. 87 is a side view of the biasing arrangement of FIG. 86.
Figure 86:
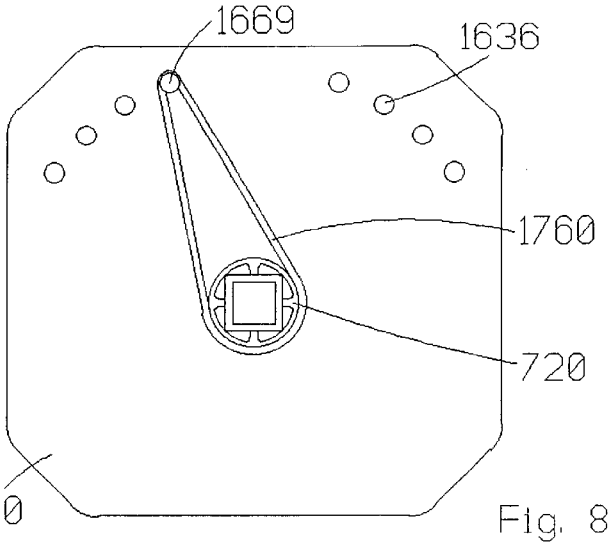
FIG. 86 is an end view of yet another biasing arrangement suitable for use in accordance with the present invention.

FIGS. 86–87 show yet another biasing arrangement suitable for use in accordance with the present invention. The arrangement is described with reference to the same handle 720, interior support 1630, and selector rod 1660 as those described above with reference to FIG. 84. The annular groove 1668 is exposed upon insertion of the end 1669 of the selector rod 1660 through any of the holes 1636 in the support 1630. An elastic band 1760 is disposed loosely about the handle 720 and may be stretched to also encompass the end 1669 of the selector rod 1660. The band 1760 is sized and configured to occupy the groove 1668 in the selector rod 1660, and the tension and presence of the band 1760 discourage movement of the selector rod 1660 axially away from the middle of the handle 720.

Figure 89:
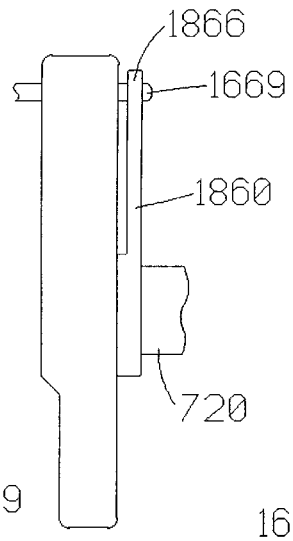
FIG. 89 is a side view of the biasing arrangement of FIG. 88.
Figure 88:
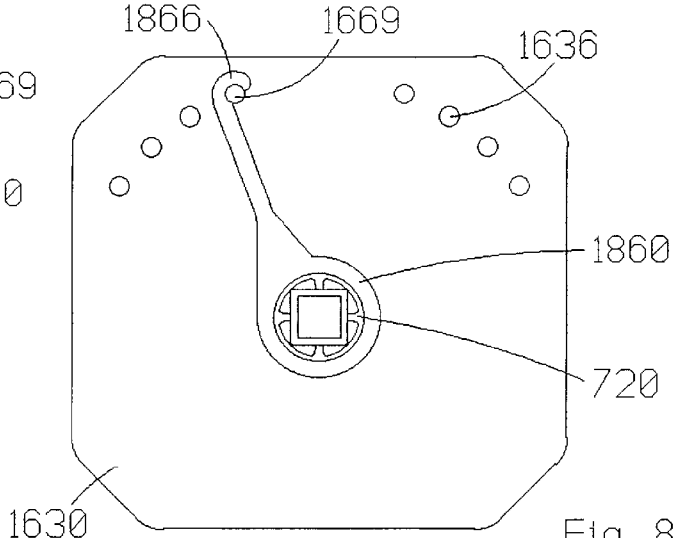
FIG. 88 is an end view of yet another biasing arrangement suitable for use in accordance with the present invention.

FIGS. 88–89 show still another biasing arrangement suitable for use in accordance with the present invention. The arrangement is also described with reference to the same handle 720, interior support 1630, and selector rod 1660 as those described above with reference to FIG. 84. A resilient hook member 1860 is rotatably mounted on the handle 720 and has a distal end 1866 which may snapped into engagement with the end 1669 of the selector rod 1660. The distal end 1866 is sized and configured to occupy the groove 1668 in the selector rod 1660 and thereby discourage movement of the selector rod 1660 axially away from the middle of the handle 720.

When free to move axially, the selector rods are rotatable into alignment with different amounts and/or combinations of weights. For example, the preferred embodiment dumbbell 700 includes three pairs of weight plates 770, 780, and 790, which weigh six pounds, three pounds, and one and one-half pounds, respectively. The plates 770, 780, and 790 are selectively secured, in any combination, to respective supports 730 and 750 by means of respective selector rods 760.

Figure 45:
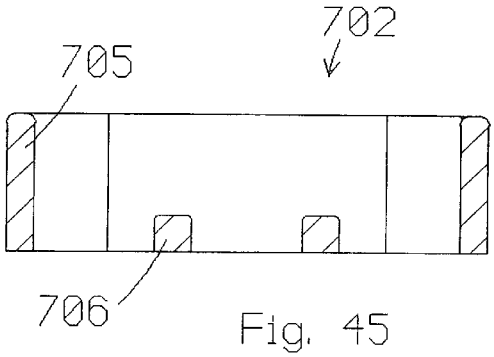
FIG. 45 is a top view of a cradle suitable for use with the dumbbell of FIG. 31.
Figure 46:
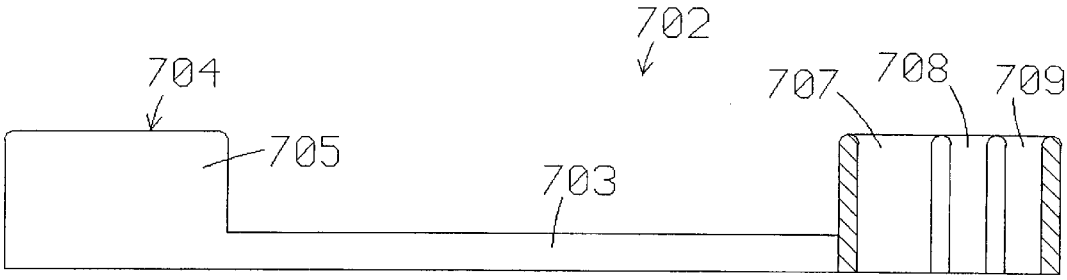
FIG. 46 is a partially sectioned side view of the cradle of FIG. 45.

When not in use, the dumbbell 700 rests on a cradle having walls sized and configured to receive the weights 770, 780, and 790. For example, a suitable cradle 702 is shown in FIGS. 45–46. The cradle 702 includes intermediate members 703 and opposite end members 704. The intermediate members 703 maintain the end members 704 an appropriate distance apart from one another. Each end member 704 is bounded by side walls 705 and at least one bottom member 706. Spacers extend inward from opposing side walls 705 of the cradle 702 and are sized and configured to align with the supports 730 and 750 and the spacers 740 on the dumbbell 700. In other words, the spacers on the cradle 702 define slots 707, 708, and 709 which are sized and configured to receive the weights 770, 780, and 790, respectively. Examples of possible cradle arrangements and/or features are disclosed in U.S. Pat. No. 4,529,198 to Hettick, Jr.; U.S. Pat. No. 4,822,034 to Shields; and U.S. Pat. No. 5,839,997 to Roth et al., which are incorporated herein by reference.

Figure 40:
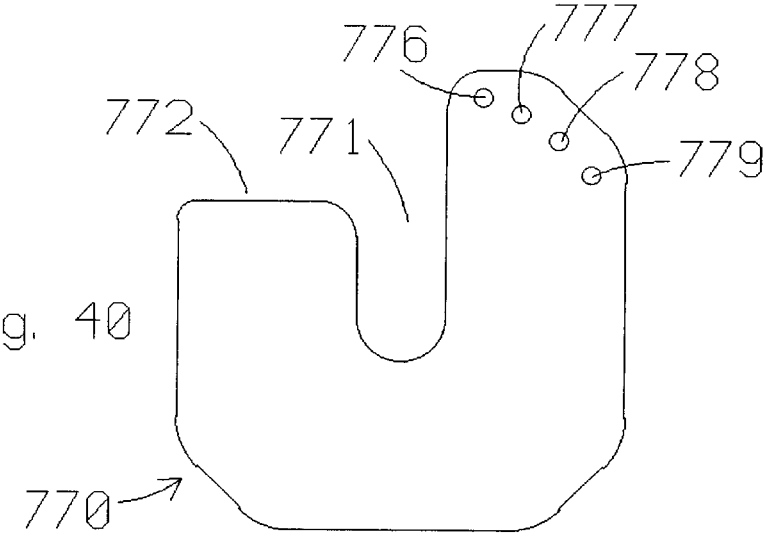
FIG. 40 is an end view of a first weight plate on the dumbbell of FIG. 31.

FIG. 40 shows one of the six pound plates 770, looking from the handle grip member 720 outward toward the exterior support 750 shown in FIG. 32. Each plate 770 is provided with an upwardly opening slot 771 sized and configured to receive both the axial offset 742 on a respective spacer 740 and an axial offset on a respective interior support 730. From a manufacturing perspective, this arrangement with the interior supports 730 is desirable because all of the intermediate spacers 740 may be made identical. On one side of the plate 770, a notch 772 provides clearance for the selector rod 760 when it is inserted into the "3" hole shown in FIG. 32 (as well as any of the "6", "9", or "12" holes). On an opposite side of the plate 770, holes 776–779 are provided to receive the selector rod 760 when it is inserted into any of the "15", "18", "21", or "24" holes, respectively.

Figure 41:
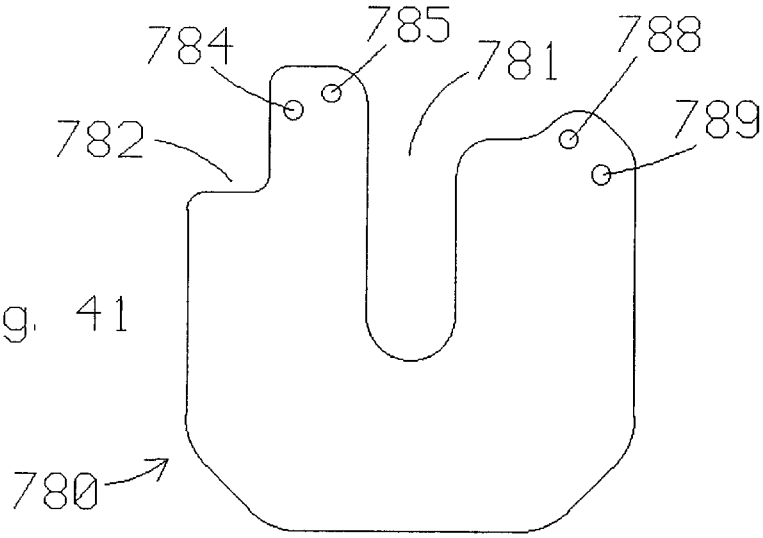
FIG. 41 is an end view of a second weight plate on the dumbbell of FIG. 31.

FIG. 41 shows one of the three pound plates 780, looking from the handle grip member 720 outward toward the exterior support 750 shown in FIG. 32. Each plate 780 is provided with an upwardly opening slot 781 sized and configured to receive the axial offset 742 on a respective spacer 740. On one side of the plate 780, a notch 782 provides clearance for the selector rod 760 when it is inserted into the "3" hole shown in FIG. 32 (as well as the "6" hole). Holes 784 and 785 are provided on this same side of the plate 780 to receive the selector rod 760 when it is inserted into either of the "9" or "12" holes, respectively. On an opposite side of the plate 780, holes 788 and 789 are provided to receive the selector rod 760 when it is inserted into either of the "21" or "24" holes, respectively. The plates 780 and 770 are sized and configured so that the holes 788 and 789 align with the holes 778 and 779, respectively.

Figure 42:
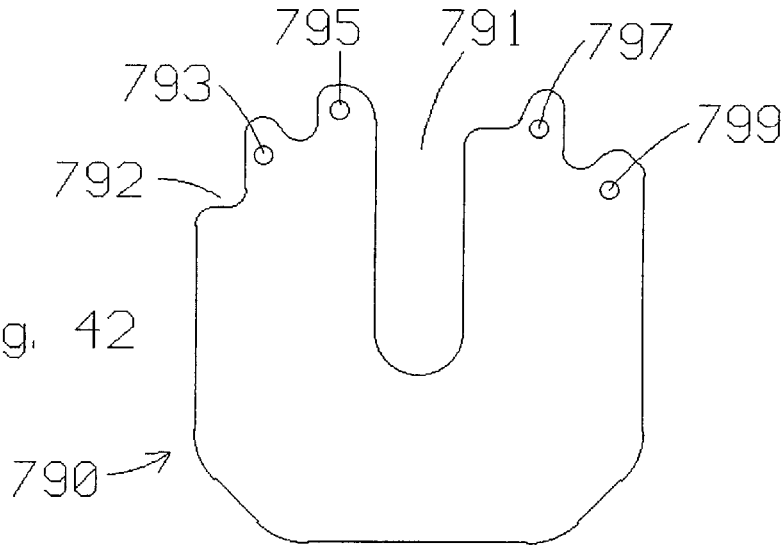
FIG. 42 is an end view of a third weight plate on the dumbbell of FIG. 31.

FIG. 42 shows one of the one and one-half pound plates 790, looking from the handle grip member 720 outward toward the exterior support 750 shown in FIG. 32. Each plate 790 is provided with an upwardly opening slot 791 sized and configured to receive the axial offset 752 on a respective exterior support 750. The plates 790 are shown with the same thickness as the plates 780 to emphasize that some or all of the plates 770, 780, and 790 can be of similar thickness if they have different densities. On one side of the plate 790, a notch 792 provides clearance for the selector rod 760 when it is inserted into the "3" hole shown in FIG. 32. Holes 793 and 795 are provided on this same side of the plate 790 to receive the selector rod 760 when it is inserted into either of the "6" or "12" holes, respectively. On an opposite side of the plate 790, holes 797 and 799 are provided to receive the selector rod 760 when it is inserted into either of the "18" or "24" holes, respectively. The plates 790 and 780 are sized and configured so that the holes 795 and 799 align with the holes 785 and 789, respectively. Also, the plates 790 and 770 are sized and configured to that the holes 797 and 799 align with the holes 777 and 779, respectively.

Figure 43:
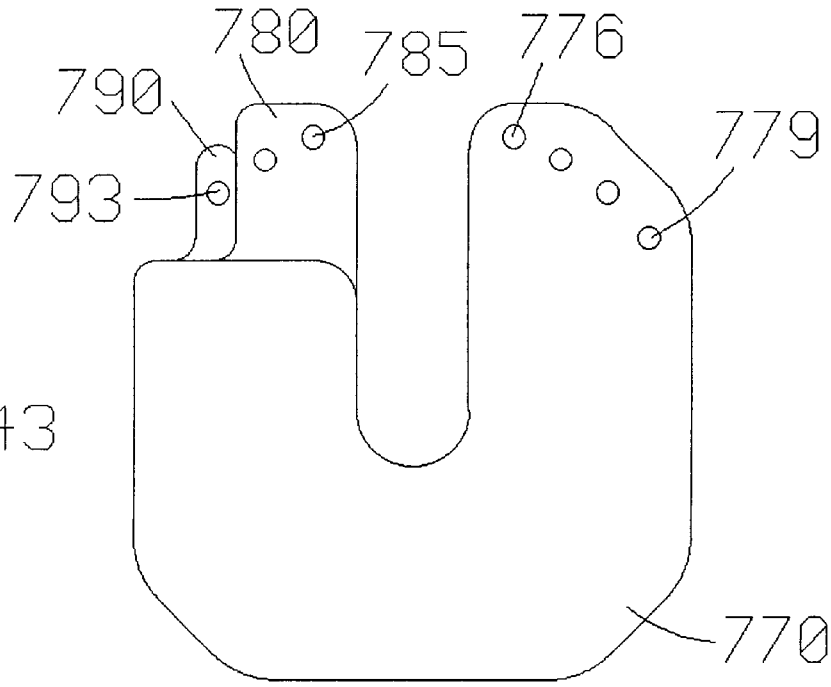
FIG. 43 is an end view of the weight plates of FIGS. 40–42 aligned with one another.
Figure 44:
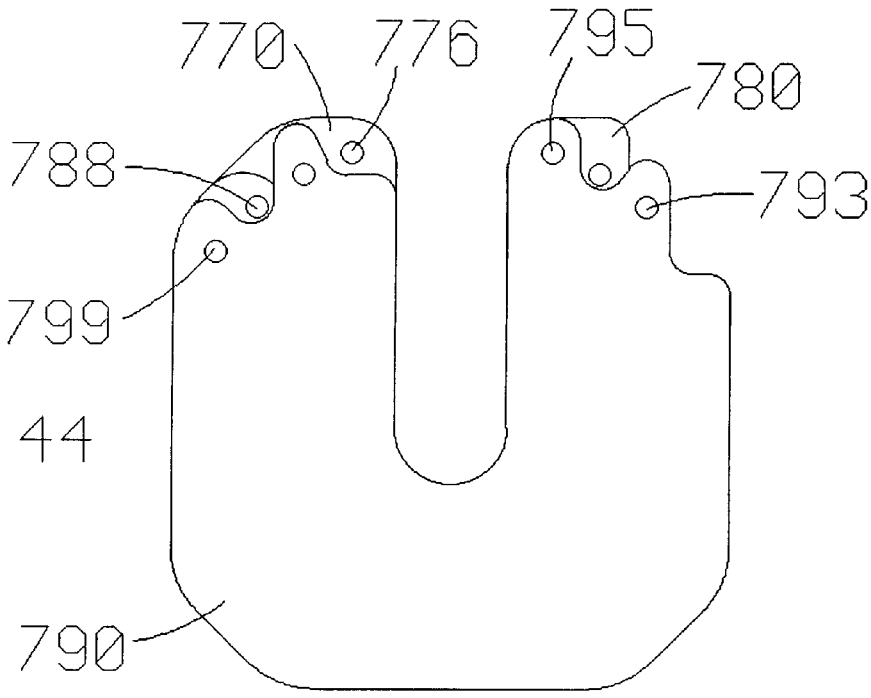
FIG. 44 is an opposite end view of the weight plates of FIG. 43.

FIGS. 43–44 show the three different plates 770, 780, and 790 axially aligned relative to one another, and FIG. 44 is viewed from the same perspective as FIG. 32. Assuming that the unloaded handle assembly (the dumbbell 700 without any of the weights 770, 780, or 790) weighs three pounds, the weights 770, 780, and 790 may be added to the handle assembly in various combinations to provide any of the dumbbell loads set forth below:

| Rod | Handle | Weights 770 | Weights 780 | Weights 790 | Total |
|---|---|---|---|---|---|
| "3" | 3 | 0 | 0 | 0 | 3 |
| "6" | 3 | 3 | 0 | 0 | 6 |
| "9" | 3 | 0 | 6 | 0 | 9 |
| "12" | 3 | 3 | 6 | 0 | 12 |
| "15" | 3 | 0 | 0 | 12 | 15 |
| "18" | 3 | 3 | 0 | 12 | 18 |
| "21" | 3 | 0 | 6 | 12 | 21 |
| "24" | 3 | 3 | 6 | 12 | 24 |

An advantage of this embodiment 700 is that only three discrete weights are required on each side of the dumbbell to provide eight different dumbbell loads. Moreover, the number of available dumbbell loads may be doubled by supplementing the dumbbell 700 with two "half-weights" which weigh three-quarters of one pound. Such half-weights may be attached to the dumbbell 700 by magnets or hook and loop fasteners, for example.

Figure 50:
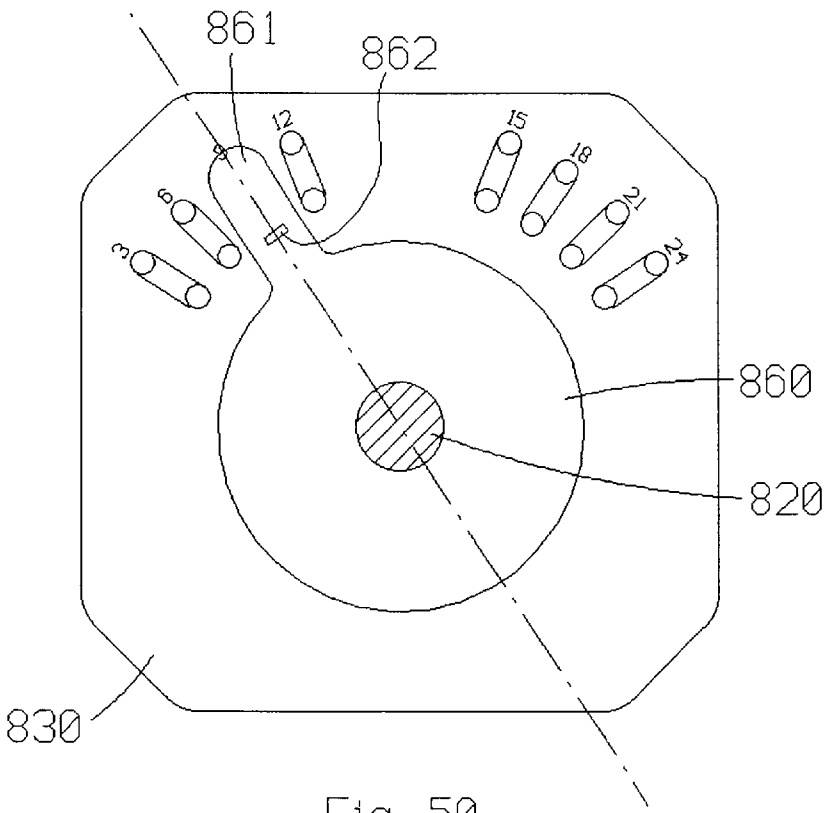
FIG. 50 is a sectioned end view of the dumbbell of FIG. 47, showing the weight selector member of FIG. 48 in front of the interior support of FIG. 49.

Another embodiment dumbbell constructed according to the principles of the present invention is designated as 800 in FIGS. 47–48. The dumbbell 800 includes a bar 820 which is made of steel and may be described with reference to three discrete sections. An intermediate section of the bar 820 has a circular profile or cross-section, as shown in FIG. 50. Each distal end portion of the bar 820 is primarily cylindrical but interrupted by a flat surface which extend lengthwise along each end of the bar (to fit snugly within the hole designated as 832 in FIG. 49). The exterior of the intermediate section may be knurled or otherwise textured to facilitate gripping thereof.

After first and second weight selecting members 860 are rotatably mounted on the intermediate section of the bar 820, first and second interior supports 830 are mounted on opposite end portions of the bar 820. Each support 830 provides a smooth inwardly facing surface which abuts a respective end of the intermediate portion of the bar 820. Each support 830 also provides an outwardly extending offset or collar 834 for reasons explained below.

Circumferentially spaced holes 836 are formed through each support 830 proximate the upper edge thereof. A visual indicator 835 is provided proximate each of the holes 836 for reasons discussed below. Also, grooves 837 extend radially inward from respective holes 836 to respective holes 838 (which are also circumferentially spaced).

Figure 51:
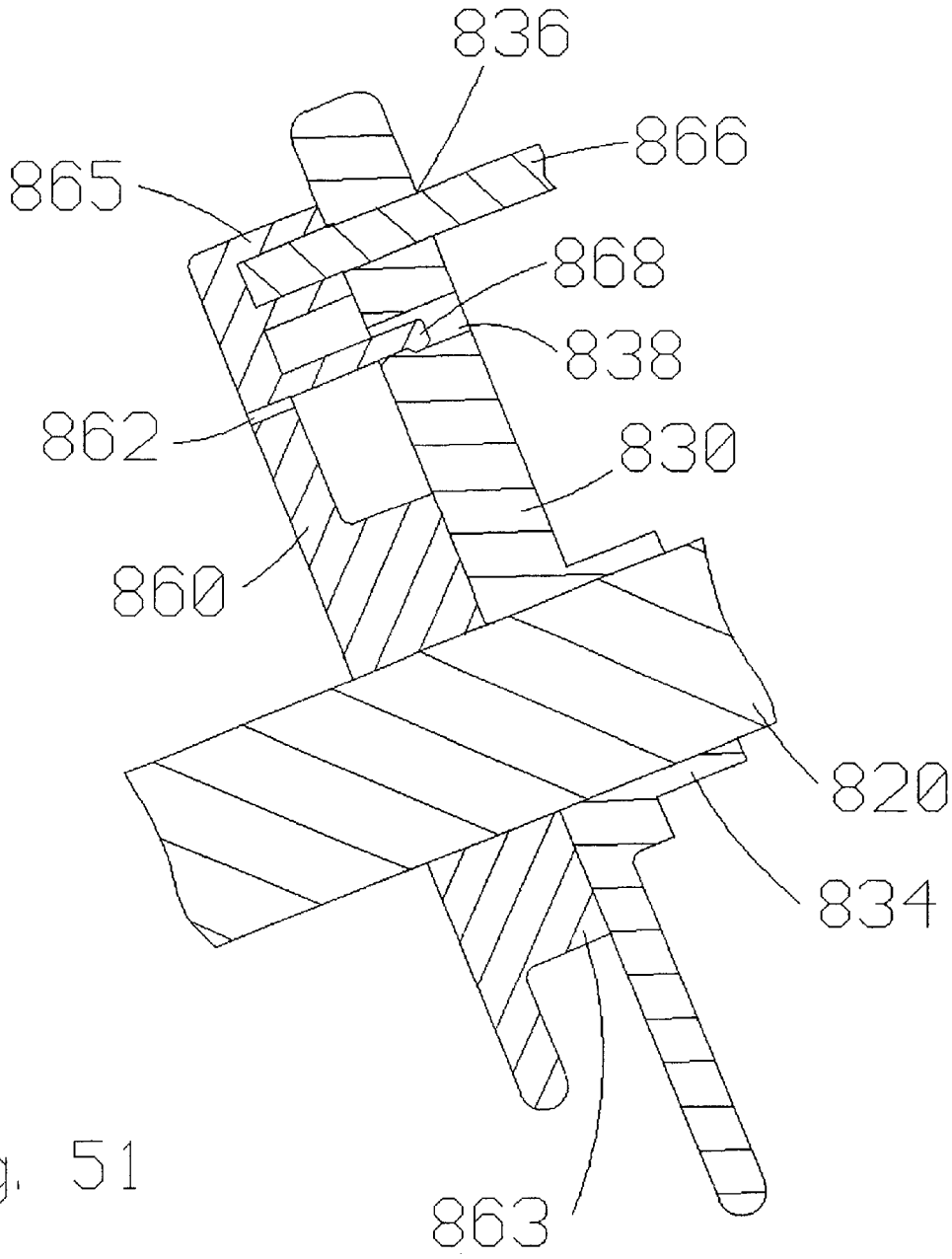
FIG. 51 is a sectioned view of the dumbbell of FIG. 47, taken along the section line shown in FIG. 50.

As shown in FIG. 50, each selecting member 860 may be described as primarily disc-shaped with a radially extending finger 861. Both a selector rod 866 and a prong 868 extend axially from the finger 861 proximate its distal end. As shown in FIG. 51, each of the holes 836 is sized and configured to receive the selector rod 866. A first end of the selector rod 866 is anchored within a boss 865 on a respective selecting member 860. An opposite, second end of each selector rod 866 terminates in a rounded tip suitable for insertion through the holes 836 (and aligned holes in any aligned dumbbell components).

FIG. 51 also shows that each of the holes 838 is sized and configured to receive the prong 868. On this embodiment 800, a first end of the prong 868 is integrally joined to the selecting member 860. As shown in FIGS. 48 and 51, an opposite, second end of the prong 868 is provided with a nub 869 sized and configured to snap into place behind a shoulder or lip on the sidewall of any of the holes 838. In this regard, the prong 868 is made of a resilient material and operates like a leaf spring. Those skilled in the art will recognize that the lips in the holes 838 may be formed during injection molding of the support 830. The nub 869 may also be formed during injection molding of the selecting member 860, by bringing a mold element through the opening designated as 862 in FIGS. 50 and 51, for example. A central boss 863 extends axially outward from each selecting member 860 to facilitate grasping of a respective rim 864 when it is abutting a respective support 830.

Figure 53:
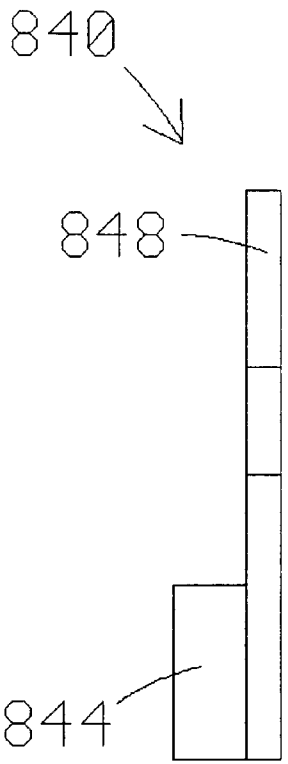
FIG. 53 is a side view of the spacer of FIG. 52.
Figure 52:
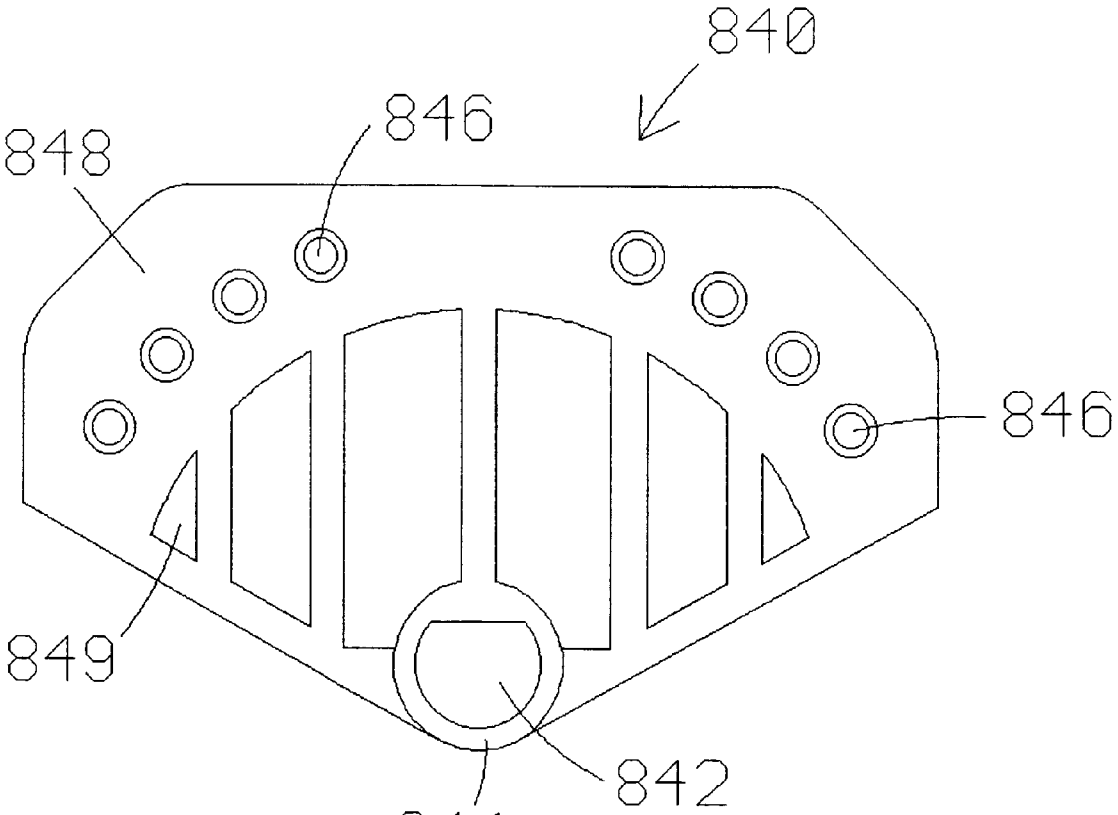
FIG. 52 is an end view of a spacer on the dumbbell of FIG. 47.

Two spacers 840 are mounted on each end of the bar 820 outside respective interior supports 830. As shown in FIGS. 52–53, each spacer 840 includes an axially extending offset 844 and a radially extending plate 848. A hole 842, sized and configured to receive an end portion of the bar 820, extends through both portions of the spacer 840. Each spacer 840 is oriented so the offset 844 extends axially inward, toward the intermediate section of the bar 820. Recessed areas 849 may be formed in the plate 848 to reduce the mass of the spacers 840 and/or to conserve resources. Circumferentially spaced holes 846 extend through each spacer 840 proximate the upper edge thereof. The sidewalls of the holes 846 extend in divergent fashion toward the intermediate section of the bar 820 to facilitate insertion of the selector rod 860 therein.

Figure 55:
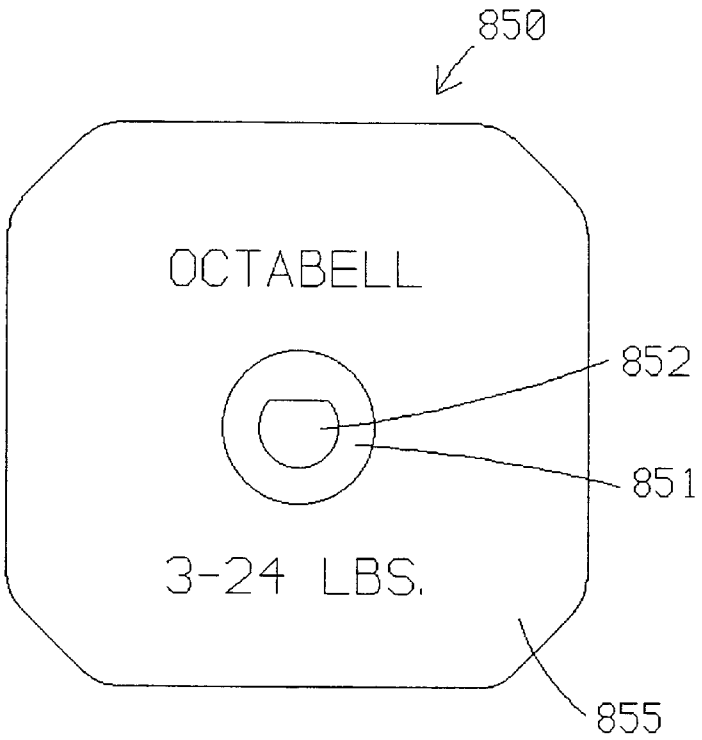
FIG. 55 is an opposite end view of the exterior support of FIG. 54.
Figure 54:
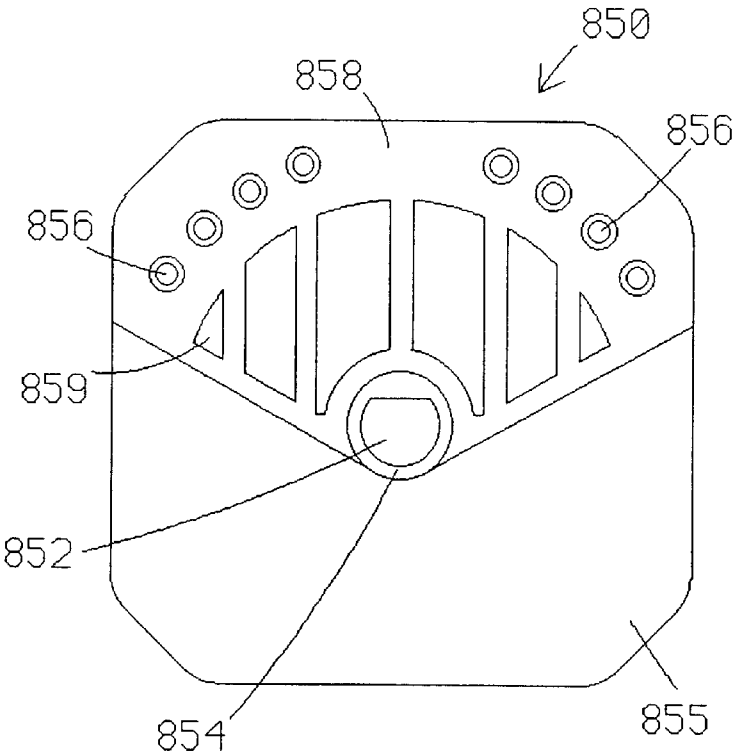
FIG. 54 is an end view of an exterior support on the dumbbell of FIG. 47.

First and second exterior supports 850 are mounted on opposite end sections of the bar 820 outside respective spacers 840. As shown in FIGS. 54–55, each support 850 has an axially extending offset or collar 854 which extends axially inward and abuts the plate portion 848 of a respective spacer 840. Each support 850 also has a radially extending plate 855 which is similar in size and configuration to the interior supports 830. A hole 852, sized and configured to receive an end portion of the bar 820, extends through both the collar 854 and the plate 855. A recessed cavity 851 is provided in the smooth, outwardly facing side of each support 850 to receive a countersunk end fastener (not shown) which is rigidly anchored to the end of the bar 820.

A plateau or offset surface 858 is provided on the inwardly facing side of each support 850, both on the upper portion thereof and about the collar 854. Recessed areas 859 may be formed in the plateau 858 to reduce the mass of the supports 850 and/or to conserve resources. Circumferentially spaced holes 856 extend into each plateau 858 proximate the upper edge thereof. The sidewalls of the holes 856 extend in divergent fashion toward the intermediate section of the bar 820 to facilitate insertion of the selector rod 860 therein. The plateau 858 provides both additional depth for receiving the selector rod 860 and space for a spacer on a cradle to extend upward between the support 850 and an adjacent weight plate 890.

The dumbbell 800 includes three pairs of weight plates 870, 880, and 890, which weigh six pounds, three pounds, and one and one-half pounds, respectively. The plates 870, 880, and 890 are selectively secured, in any combination, to respective supports 830 and 850 and spacers 840 by means of respective selector rods 860. When not in use, the dumbbell 800 rests on a cradle having walls and/or spacers sized and configured to receive and retain the weights 870, 880, and 890. As on the preferred embodiment cradle 702, spacers extend inward and/or upward from one or more walls of the cradle to align with the supports 830 and 850 and the spacers 840 and thereby maintain the proper alignment and spacing between the weights 870, 880, and 890.

Figure 49:
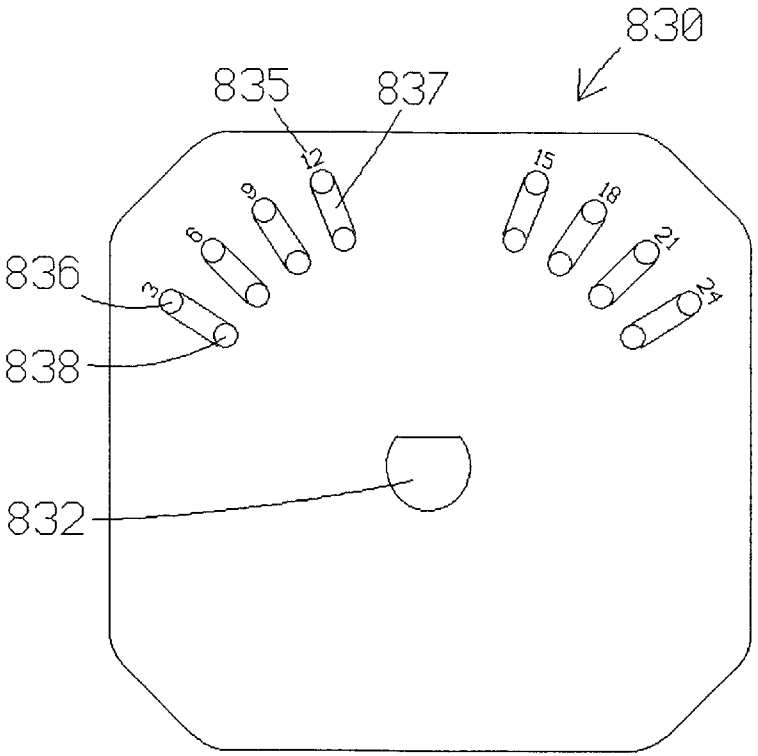
FIG. 49 is an end view of an interior support on the dumbbell of FIG. 47.
Figure 56:
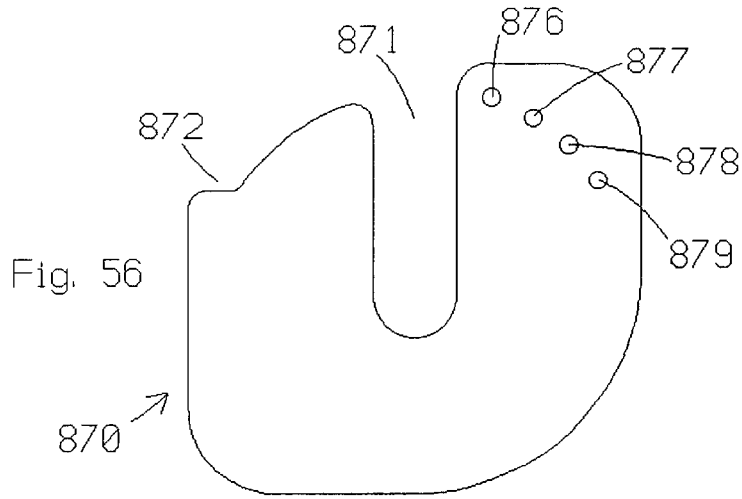
FIG. 56 is an end view of a first weight plate on the dumbbell of FIG. 47.

FIG. 56 shows one of the six pound plates 870, as viewed from the intermediate section of the bar 820 outward toward the interior support 830 shown in FIGS. 49 and 50. Each plate 870 is provided with an upwardly opening slot 871 sized and configured to receive both the axial offset 844 on a respective spacer 840 and the axial offset 834 on a respective interior support 830. Again, this arrangement of offsets is desirable because all of the intermediate spacers 840 may be made identical. On one side of the plate 870, a notch 872 provides clearance for the selector rod 860 when it is inserted into the "3" hole shown in FIGS. 49 and 50 (as well as any of the "6", "9", or "12" holes). On an opposite side of the plate 870, holes 876–879 are provided to receive the selector rod 860 when it is inserted into any of the "15", "18", "21", or "24" holes, respectively.

Figure 57:
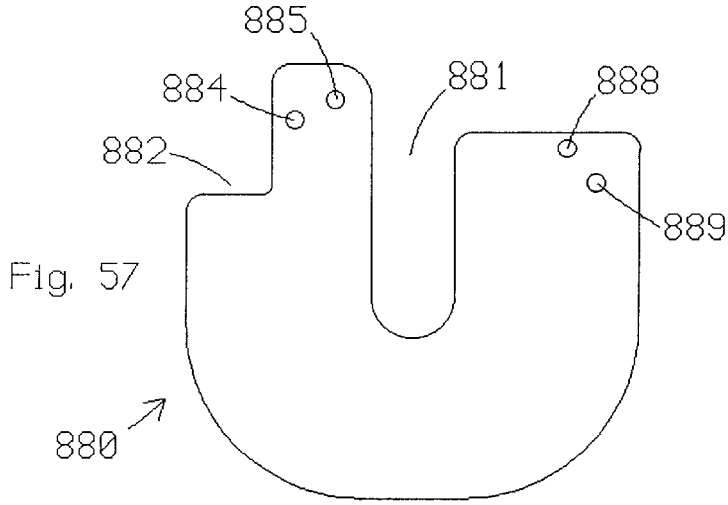
FIG. 57 is an end view of a second weight plate on the dumbbell of FIG. 47.

FIG. 57 shows one of the three pound plates 880, as viewed from the intermediate section of the bar 820 outward toward the interior support 830 shown in FIGS. 49–50. Each plate 880 is provided with an upwardly opening slot 881 sized and configured to receive the axial offset 844 on a respective spacer 840. On one side of the plate 880, a notch 882 provides clearance for the selector rod 860 when it is inserted into the "3" hole shown in FIGS. 49–50 (as well as the "6" hole). Holes 884 and 885 are provided on this same side of the plate 880 to receive the selector rod 860 when it is inserted into either of the "9" or "12" holes, respectively. On an opposite side of the plate 880, holes 888 and 889 are provided to receive the selector rod 860 when it is inserted into either of the "21" or "24" holes, respectively. The plates 880 and 870 are sized and configured so that the holes 888 and 889 align with the holes 878 and 879, respectively, to facilitate contemporaneous engagement of both plates 880 and 870 in these two selector rod orientations.

Figure 58:
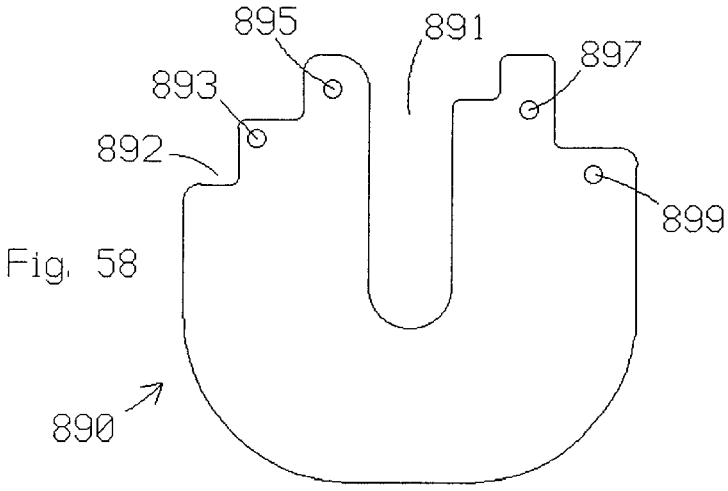
FIG. 58 is an end view of a third weight plate on the dumbbell of FIG. 47.

FIG. 58 shows one of the one and one-half pound plates 890, as viewed from the intermediate portion of the bar 820 outward toward the interior support 830 shown in FIGS. 49–50. Each plate 890 is provided with an upwardly opening slot 891 sized and configured to receive the axial offset 854 on a respective exterior support 850. The plates 890 are shown with one-half the thickness of the plates 880 to emphasize that the plates 870, 880, and 890 can be equally dense. On one side of the plate 890, a notch 892 provides clearance for the selector rod 860 when it is inserted into the "3" hole shown in FIGS. 49–50. Holes 893 and 895 are provided on this same side of the plate 890 to receive the selector rod 860 when it is inserted into either of the "6" or "12" holes, respectively. On an opposite side of the plate 890, holes 897 and 899 are provided to a receive the selector rod 860 when it is inserted into either of the "18" or "24" holes, respectively. The plates 890 and 880 are sized and configured so that the holes 895 and 899 align with the holes 885 and 889, respectively, to facilitate contemporaneous engagement of both plates 890 and 880 in these two selector rod orientations. Also, the plates 890 and 870 are sized and configured to that the holes 897 and 899 align with the holes 877 and 879, respectively, to facilitate contemporaneous engagement of both plates 890 and 870 in these two selector rod orientations.

Figure 59:
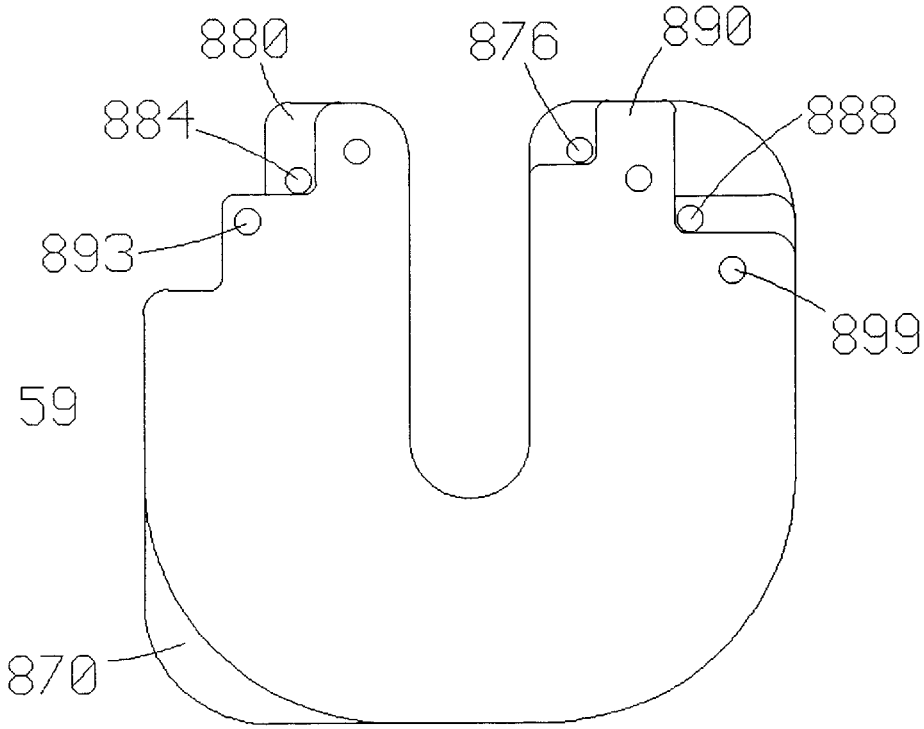
FIG. 59 is an end view of the weight plates of FIGS. 56–58 aligned with one another.

FIG. 59 shows the three different plates 870, 880, and 890 aligned relative to one another, and viewed from the same perspective as FIGS. 56–58. Assuming that the unloaded handle assembly (the dumbbell 800 without any of the plates 870, 880, or 890) weighs three pounds, the weight plates 870, 880, and 890 may be added to the handle assembly to provide the same range of dumbbell loads as the preferred embodiment 700.

An advantage of the dumbbell 800 is that a user's hand is placed between the selecting members 860 when the dumbbell 800 is in use. Also, the extent of the offsets 863 may be made adjustable to customize the distance between the opposing rims 864. In any event, the selecting members 860 are less likely to withdraw during use, and/or a user is less likely not to notice withdrawal of the selecting members 860 during use. Another advantage of the dumbbell 800 is that the spacers 840 support the selector rods 860 at intermediate positions between the supports 830 and 850. Also, the dumbbell 800 may be described as somewhat more self-contained, since the selecting members 860 may be operated within the planform of the dumbbell 800. With respect to the biasing arrangement on the dumbbell 800, those skilled in the art will recognize that it may be adapted for use on the dumbbell 700, and/or one or more biasing arrangements described with reference to the dumbbell 700 may be adapted for use on the dumbbell 800.

Figure 60:
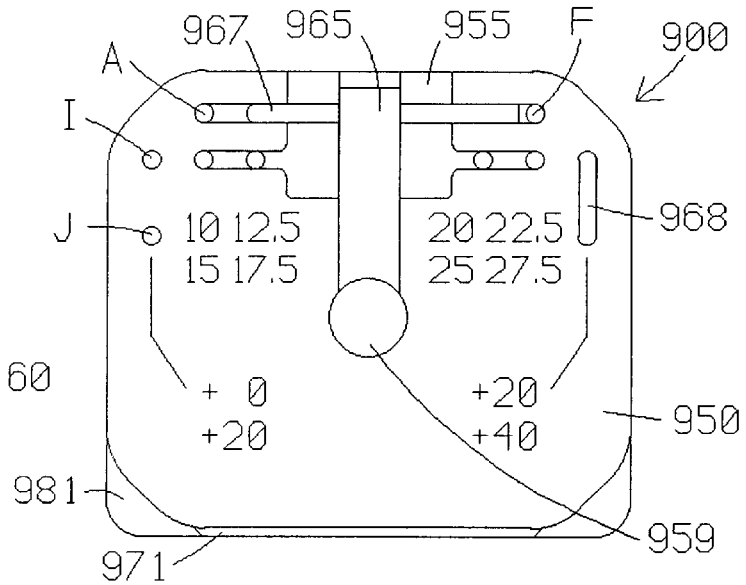
FIG. 60 is an end view of another alternative embodiment dumbbell constructed according to the principles of the present invention.

Yet another dumbbell constructed according to the principles of the present invention is designated as 900 in FIG. 60. The dumbbell 900 is generally similar in construction and operation to the dumbbells 700 and 800 described above. Therefore, the following description of the dumbbell 900 will focus primarily on its unique attributes.

The dumbbell 900 has two selector rods 967 and 968 which extend the entire length of the dumbbell 900. The first selector rod 967 may be described as an L-shaped bar having a relatively shorter segment which extends radially across one of the end supports 950, and a relatively longer segment which extends axially between the end supports 950 (and through interior supports and any selected weight plates). The longer segment may be inserted into any of eight different holes in the end support 950. The respective locations of these holes are designated as A–H in FIGS.

60–65. The shorter segment may be secured relative to the end support 950 by means of a spring clip 965 and/or by another suitable means. The clip 965 is made of steel and secured between the end support 950 and the end fastener 959. In the alternative, the clip 965 may be an integrally molded portion of the end support 950. A recessed area 955 in the end support 950 provides access to the inward side of the shorter segment of the selector rod 967, for purposes of grasping same. Grooves extend from the recessed area 955 to the outer holes A, C, F, and H to seat the shorter segment of the selector rod 967 in a desired position relative to the end support 950.

The second selector rod 968 may be described as a J-shaped bar having a relatively longer axial segment, a relatively shorter axial segment, and an intermediate radial segment extending therebetween. The longer axial segment extends between the end supports 950 (and through interior supports and any selected weight plates) and may be inserted into any of four different holes in the end support 950. The respective locations of these holes are designated as I–L in FIGS. 60–65. The shorter axial segment may be inserted into an adjacent one of the holes I–L, depending on the position of the longer axial segment. The shorter axial segment only extends into the one end support 950 and may be secured relative thereto by means of a ball detent arrangement and/or by another suitable means.

Figure 61:
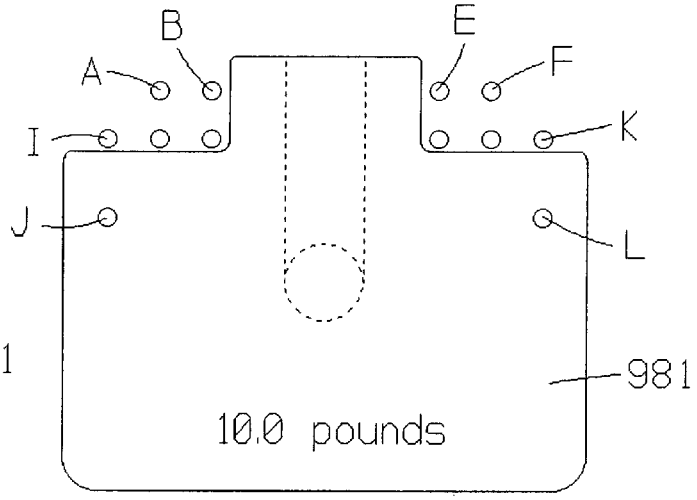
FIG. 61 is an end view of a first weight plate on the dumbbell of FIG. 60.
Figure 62:
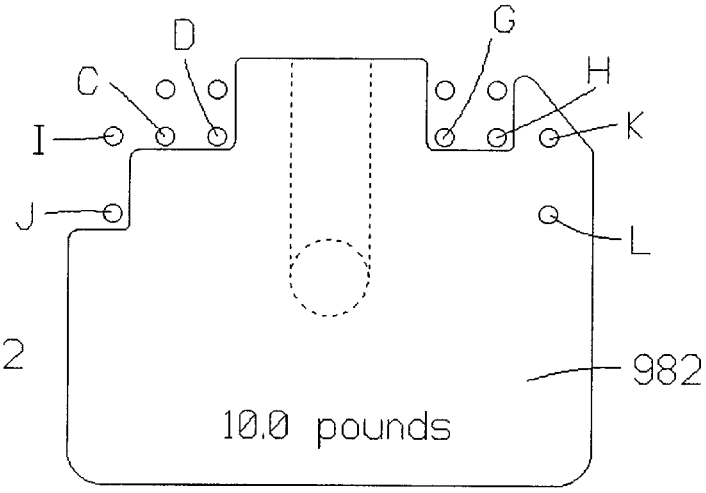
FIG. 62 is an end view of a second weight plate on the dumbbell of FIG. 60.
Figure 63:
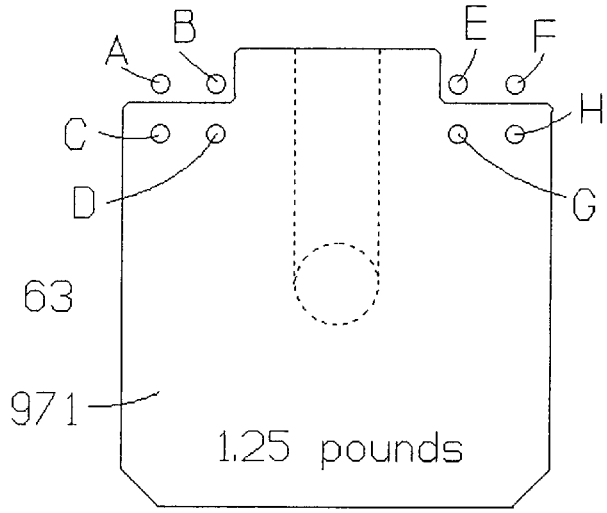
FIG. 63 is an end view of a third weight plate on the dumbbell of FIG. 60.
Figure 64:
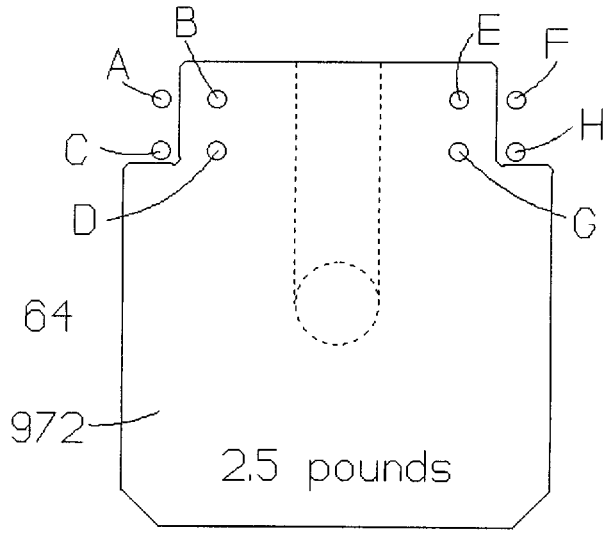
FIG. 64 is an end view of a fourth weight plate on the dumbbell of FIG. 60.
Figure 65:
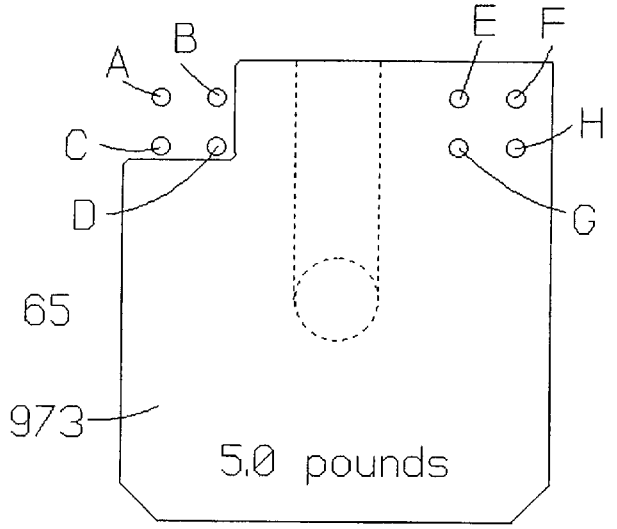
FIG. 65 is an end view of a fifth weight plate on the dumbbell of FIG. 60.

The dumbbell 900 includes a pair of weight plates 981 and a pair of weight plates 982 which are disposed at opposite ends of the dumbbell 900. In particular, each of the plates 981 is disposed just outside a respective interior support, and each of the plates 982 is disposed just outside a respective plate 981. As shown in FIGS. 61–62, the plates 981 and 982 are configured to be bypassed by the first selector rod 967 regardless of the hole A–H occupied by same. Furthermore, the plate 981 is configured to be engaged by the second selector rod 968 when its longer segment occupies either hole J or hole L. Also, the plate 982 is configured to be engaged by the second selector rod 968 when its longer segment occupies either hole K or hole L. In other words, when the longer segment of the second selector rod 968 occupies hole location I, neither of the plates 981 or 982 is engaged; and when the longer segment of the second selector rod 968 occupies hole location J, only the plate 981 is engaged; and when the longer segment of the second selector rod 968 occupies hole location K, only the plate 982 is engaged; and when the longer segment of the second selector rod 968 occupies hole location L, both of the plates 981 and 982 are engaged. Assuming that each of the plates 981 and 982 weighs ten pounds, the pairs of weights 981 and 982 are available to add twenty to forty pounds of weight to the dumbbell 900 in twenty pound increments.

The dumbbell 900 also includes pairs of weight plates 971–973 which are disposed at opposite ends of the dumbbell 900. In particular, each of the plates 973 is disposed just outside a respective plate 982; each of the plates 972 is disposed just outside a respective plate 973; and each of the plates 971 is disposed just outside a respective plate 972 (and just inside a respective end support 950). The plates 971–973 are configured to be bypassed by the second selector rod 968 regardless of the hole I–L occupied by same. Furthermore, the plate 971 is configured to be engaged by the first selector rod 967 when its longer segment occupies any of the holes C–D or G–H; the plate 972 is configured to be engaged by the first selector rod 967 when its longer segment occupies any of the holes B, D–E, or G; and the plate 973 is configured to be engaged by the first selector rod 967 when its longer segment occupies any of the holes E–G.

Assuming that each of the plates 971 weigh one and one-quarter pounds, and each of the plates 972 weighs two and one-half pounds, and each of the plates 973 weighs five pounds, the plates 971–973 are available to add two and one-half to seventeen and one-half pounds of weight to the dumbbell 900, in two and one-half pound increments. Indicia on the end support 950 show the weight of the dumbbell 900 for each of the possible selector rod locations (with an unloaded handle assembly weighing ten pounds).

In each of the FIGS. 61–65, a respective weight plate is depicted with an elongate slot and handle location shown in dashed lines to emphasize that the slots are not necessary if the handle does not extend across the plates. In this regard, rigid boxes or frames may be provided to partially enclose and selectively retain the weight plates, and the handle may be configured to extend only between the two boxes. The boxes or frames may include flanges to space the weight plates and/or support intermediate portions of the selector rod(s).

Figure 67:
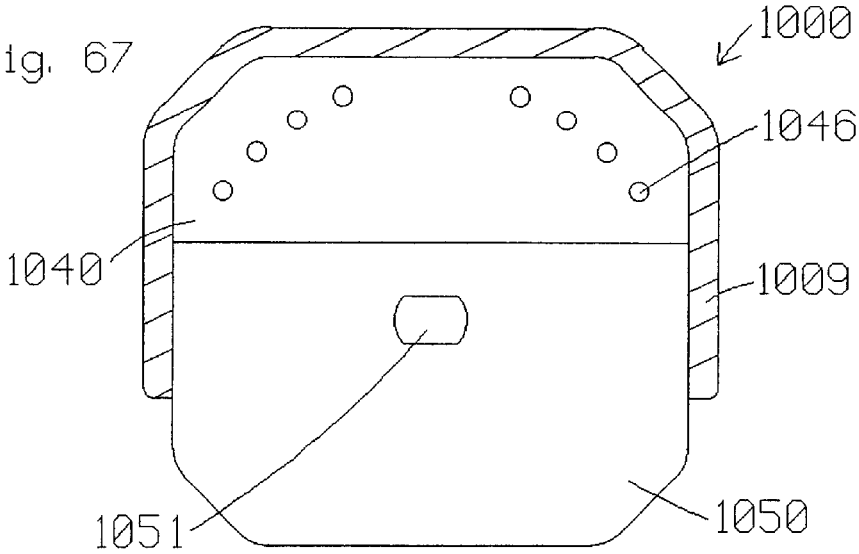
FIG. 67 is a sectioned end view of the weight supporting member of FIG. 66, taken along the section line 67–67.
Figure 66:
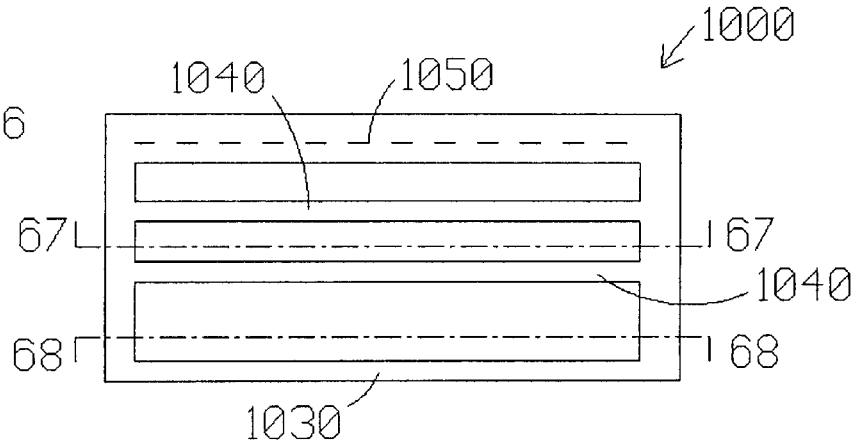
FIG. 66 is a bottom view of a weight supporting member constructed according to the principles of the present invention and suitable for use in place of certain components on the preferred embodiment dumbbell of FIG. 31.
Figure 68:
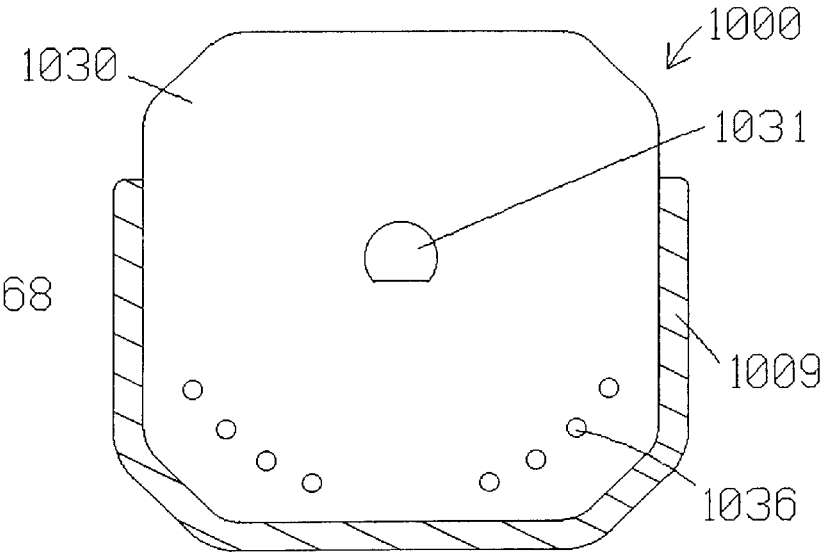
FIG. 68 is a sectioned end view of the weight supporting member of FIG. 66, taken along the section line 68–68.

Another possible weight supporting assembly, suitable for use on any of the dumbbells 700, 800, or 900, is designated as 1000 in FIGS. 66–68. This assembly 1000 includes box-like weight supporting members like those suggested above but also is configured for use with a "full length" handle.

The assembly 1000 may be described as a shell or housing having a U-shaped cross-section or outer wall 1009 which opens downward when properly oriented relative to an underlying cradle. One end of the wall 1009 is bounded by an interior support 1030 which has a profile comparable to that of the dumbbell as a whole. A central opening 1031 extends through the support 1030 to receive an end portion of a shaft having a profile comparable in configuration to the opening 1031. Circumferentially spaced holes 1036 extend through the support 1030 to accommodate a selector rod. An opposite end of the wall 1009 is bounded by an exterior support 1050 which also has a profile comparable to that of the dumbbell as a whole. A central opening 1051 extends through the support 1050 to receive an end of a shaft having a profile comparable in configuration to the opening 1051. The support 1050 is retained on the end of the shaft, between an end fastener and the end portion (disposed between the end and the handle portion of the shaft). Circumferentially spaced holes extend through the support 1050, in alignment with the holes 1036 (and holes 1046) to accommodate the selector rod.

Intermediate the supports 1030 and 1050, spacers 1040 extend inward and downward from the wall 1009 to define weight receiving cavities therebetween. Circumferentially spaced holes 1046 extend through the spacers 1040 to accommodate the selector rod. An advantage of this assembly 1000 is that it can be manufactured as a single, integrally molded unit. Another advantage is that the wall 1009 shrouds the upper half of the dumbbell.

Figure 70:
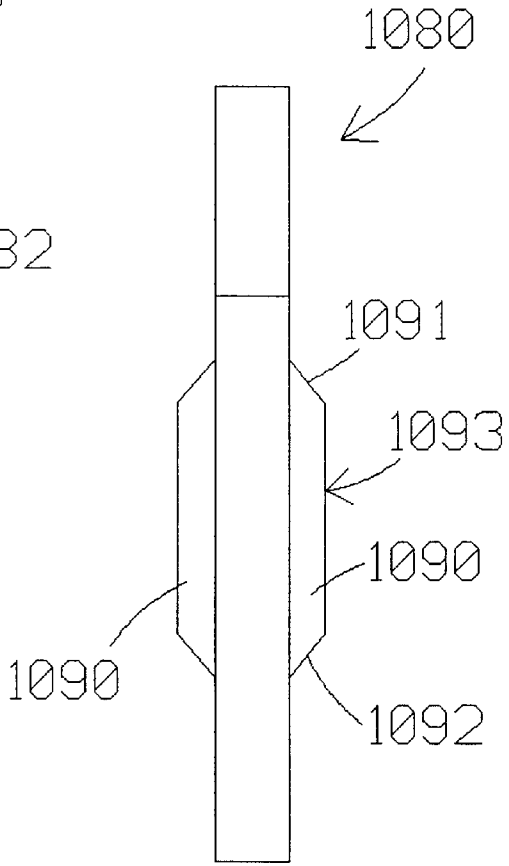
FIG. 70 is a side view of the weight plate of FIG. 69.
Figure 69:
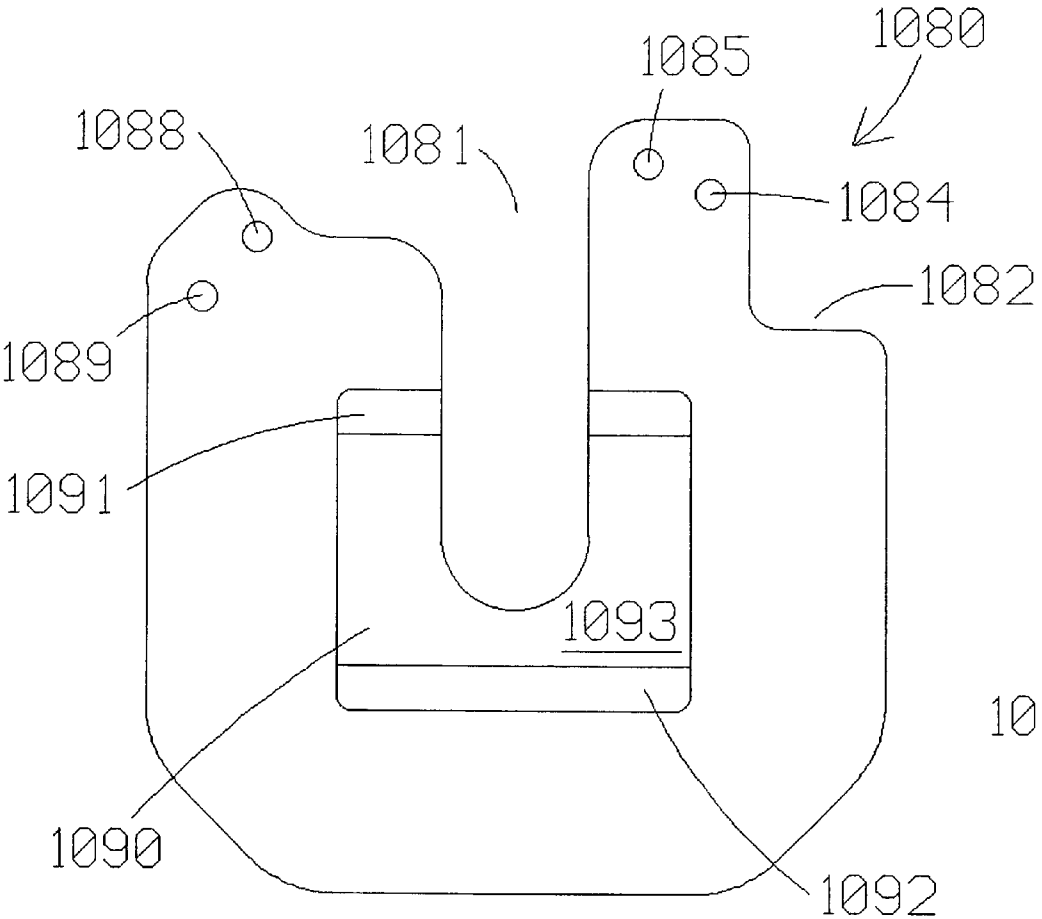
FIG. 69 is an end view of a weight plate suitable for use with the weight supporting member of FIG. 66.

FIGS. 69–70 show a weight plate 1080 which is provided with built-in spacers 1090, and which may be used, for example, together with the assembly 1000 and/or on the preferred embodiment dumbbell 700 (with the elimination of the spacers 740). For purposes of demonstrating interchangeability, the weight plate 1080 has the same end profile as the weight plate 780 shown in FIG. 41 (but is viewed from an opposite end). Like the plate 780, the plate 1080 includes an elongate slot 1081 and a notch 1082. Also, holes 1084–1085 and 1088–1089 extend through the plate 1080 to accommodate the selector rod. The spacers or axial offsets 1090 extend outward from each end of the plate

1080, recognizing that other arrangements are also possible with respect to adjacent weights.

Each spacer 1090 includes an upwardly inclined or beveled surface 1091, a downwardly inclined or beveled surface 1092, and an intermediate surface 1093 which extends radially. With reference to the preferred embodiment dumbbell 700, for example, one of the surfaces 1093 bears against the weight plate 1070, and the other surface bears against the weight plate 1090. The beveled surfaces 1091 and 1092 facilitate the return of any selected weight plates relative to any unselected weight plates.

Figure 71:
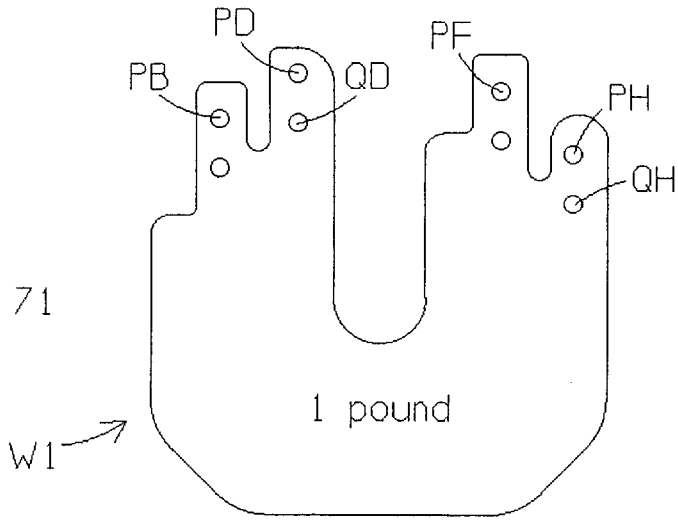
FIG. 71 is a side view of yet another dumbbell constructed according to the principles of the present invention.
Figure 72:
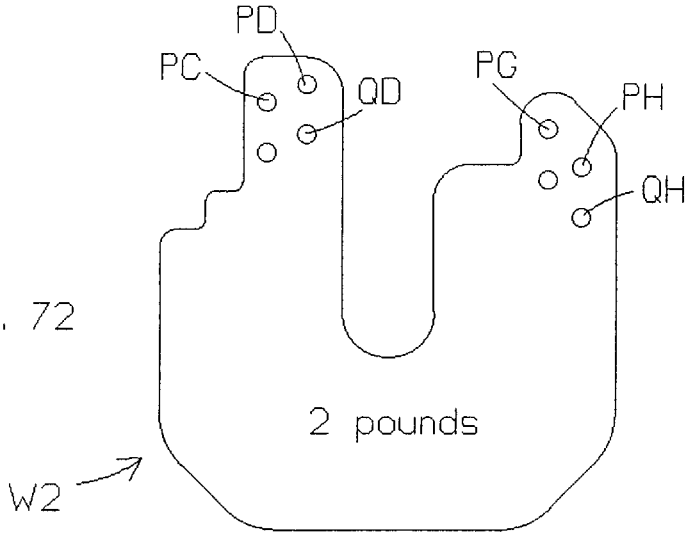
FIG. 72 is a top view of the dumbbell of FIG. 71.

Yet another dumbbell constructed according to the principles of the present invention is designated as 1100 in FIGS. 71–72. The dumbbell 1100 includes a handle 1110 which is rigidly secured between opposite weight supports 1120. Each weight support 1120 includes an inner wall 1122, an outer wall 1124, and two intermediate spacers 1126. The inner wall 1122 and the relatively closer intermediate spacer 1126 define a gap sized and configured to receive a twenty-pound weight plate 1131, for example. The intermediate spacers 1126 cooperate to define a gap sized and configured to receive a ten-pound weight 1132, for example. The outer wall 1122 and the relatively closer intermediate spacer 1126 define a gap sized and configured to receive a five-pound weight 1133, for example.

Figure 75:
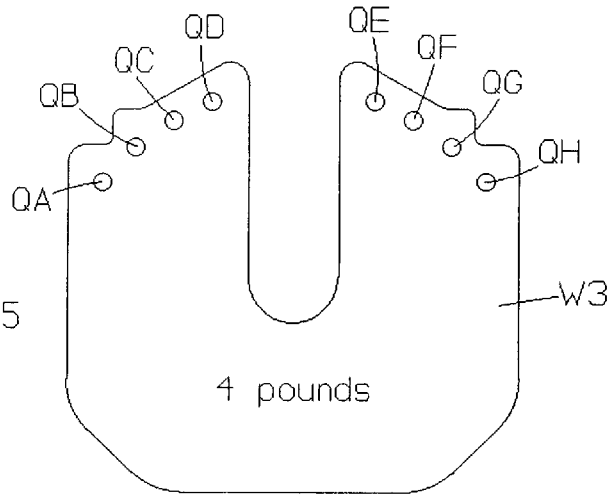
FIG. 75 is an end view of all of the weight plates on the dumbbell of FIG. 71.

Each of the weights 1131–1133 has the profile designated as 1139 in FIG. 75. The profile 1139 may be described as square with rounded corners and an upwardly opening, elongate slot 1141 sized and configured to receive one of the weight supports 1120. One sidewall of the slot 1141 is provided with a notch 1143 which cooperates with a selector rod to selectively latch and unlatch the weights 1131–1133 relative to the weight supports 1120. The selector rod is rotatably mounted relative to both the weight supports 1120 and the handle 1110. A knob 1119 is rigidly connected to one end of the selector rod.

When not in use, the dumbbell 1100 is stored within a cradle having walls sized and configured to receive the weights 1131–1133. Spacers extend inward from one or more walls of the cradle to align with the walls 1122 and 1124 and the spacers 1126 on the weight supports 1120 and thereby maintain the same spacing between the weights 1131–1133. Examples of suitable cradle arrangements are disclosed herein and/or in the patents incorporated herein by reference.

Figure 76:
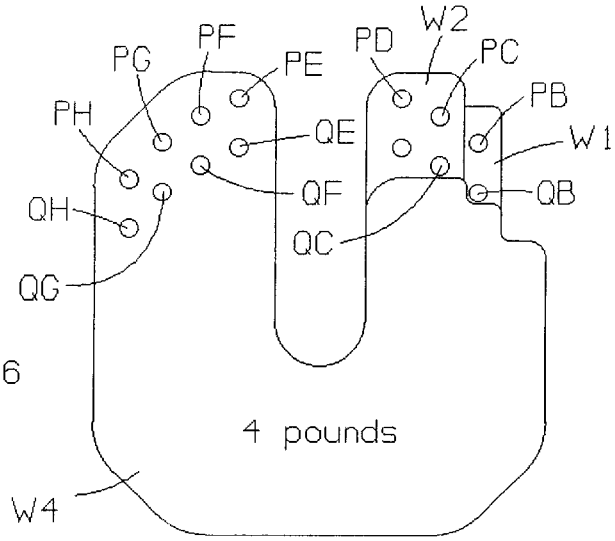
FIG. 76 is a segment of a selector rod on the dumbbell of FIG. 71, disposed at an axial location corresponding with the outermost weight on either side of the dumbbell.
Figure 77:
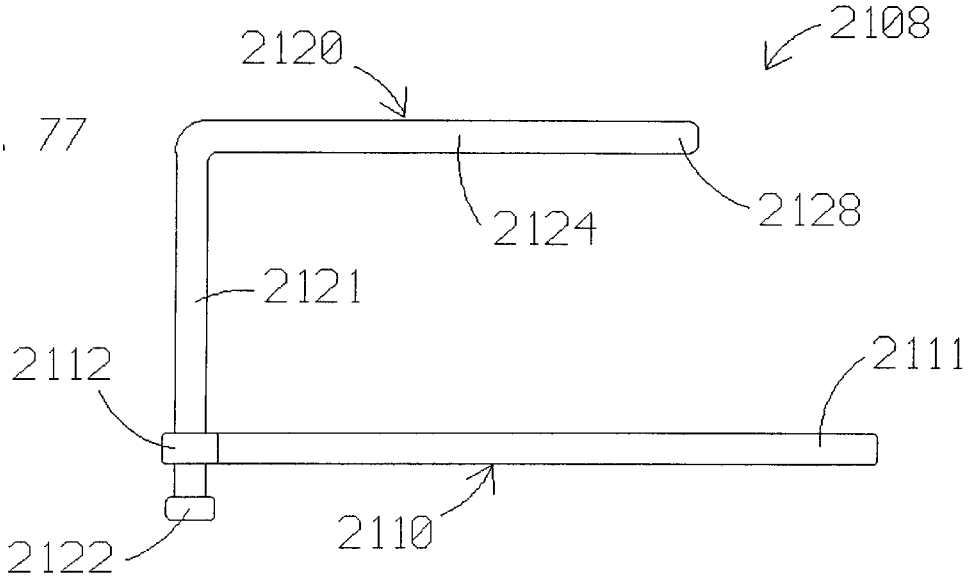
FIG. 77 is a segment of the selector rod on the dumbbell of FIG. 71, disposed at an axial location corresponding with the intermediate weight on either side of the dumbbell.
Figure 78:
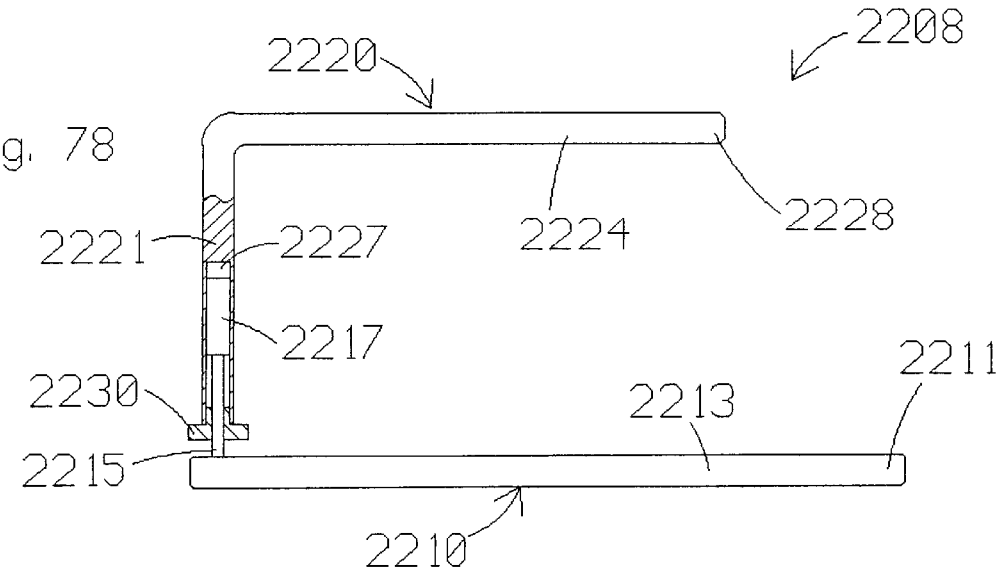
FIG. 78 is a segment of the selector rod on the dumbbell of FIG. 71, disposed at an axial location corresponding with the innermost weight on either side of the dumbbell.

Different profiles or segments of the selector rod are shown in FIGS. 76–78. The selector rod is a rigid member, and the segments 1111–1113 are integral portions thereof. The same relative orientations of the segments 1111–1113 is maintained throughout FIGS. 76–78. The segments 1111–1113 may be described with reference to eight sections, each of which is bounded by either an arc or a chord. The radially extending dividing lines are shown for ease of reference.

The segment designated as 1111 and shown in FIG. 78 is axially aligned with either of the twenty-pound weights 1131. Beginning with the "three o'clock" section designated as 1114 and proceeding clockwise, four adjacent sections are labeled with a "U" and bounded by a chord. The remaining four adjacent sections are labeled with an "L" and bounded by an arc. The segment designated as 1112 and shown in FIG. 77 is axially aligned with either of the ten-pound weights 1132. Beginning with the "three o'clock" section designated as 1114 and proceeding clockwise, two adjacent sections are labeled with a "U" and bounded by a chord; the next two adjacent sections are labeled with an "L" and bounded by an arc; the next two adjacent sections, diametrically opposed from the first two sections, are labeled with a "U" and bounded by a chord; and finally, the remaining two adjacent sections are labeled with an "L" and bounded by an arc. The segment designated as 1113 and shown in FIG. 76 is axially aligned with either of the five-pound weights 1133. Beginning with the "three o'clock" section designated as 1114 and proceeding clockwise, every other section is labeled with a "U" and bounded by a chord, and the remaining sections are labeled with an "L" and bounded by an arc.

Each of the weights 1131–1133 is selectively connected to the handle 1110 by rotating the selector rod relative thereto. With reference to FIGS. 75–78, when the rod is oriented as shown, none of the segments 1111–1113 projects into the notch 1143 in any of the weights 1131–1133. As a result, when the handle 1110 is lifted upward away from the cradle, the weights 1131–1133 remain in the cradle. In this regard, the "U" indicates that the weight will be "unlatched" relative to the handle 1110, when the section 1114 is aligned with the notch 1143. The dumbbell 1100 is preferably designed to weigh five pounds in this "unloaded" configuration.

When the rod is rotated counter-clockwise forty-five degrees, only the segments 1113 project into the notches 1143 in the five-pound weights 1133. In this regard, the "L" indicates that the weight will be "latched" relative to the handle 1110, when the section 1115 is aligned with the notch 1143. In this second configuration, the dumbbell 1100 weighs fifteen pounds. A chart of the various selector rod orientations and resulting dumbbell loads is provided below:

| Rod | Handle | Weights 1131 | Weights 1132 | Weights 1133 | Total |
|---|---|---|---|---|---|
| — | 5 | 0 | 0 | 0 | 5 |
| 45 ° | 5 | 10 | 0 | 0 | 15 |
| 90 ° | 5 | 0 | 20 | 0 | 25 |
| 135 ° | 5 | 10 | 20 | 0 | 35 |
| 180 ° | 5 | 0 | 0 | 40 | 45 |
| 225 ° | 5 | 10 | 0 | 40 | 55 |
| 270 ° | 5 | 0 | 20 | 40 | 65 |
| 315 ° | 5 | 10 | 20 | 40 | 75 |
| 360 ° | 5 | 0 | 0 | 0 | 5 |

Figure 73:
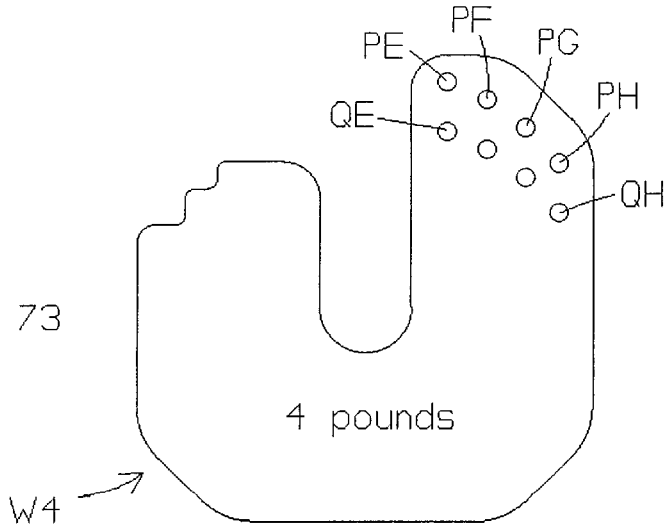
FIG. 73 is an end view of an optional weight plate suitable for use on the dumbbell of FIG. 71.
Figure 74:
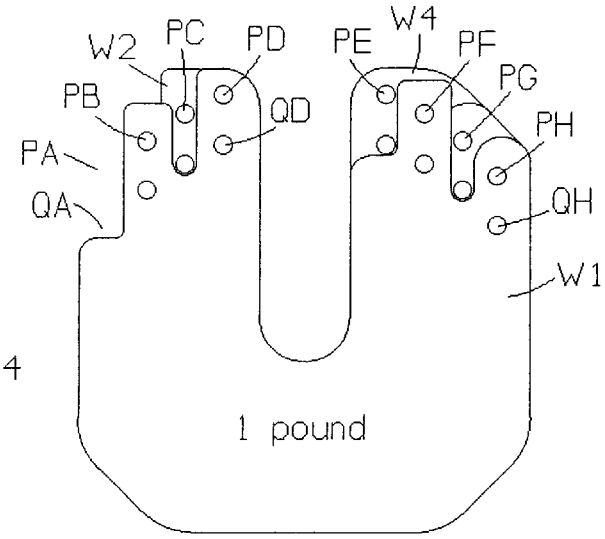
FIG. 74 is a side view of the weight plate of FIG. 73.

As on certain other embodiments described herein, only three discrete weights are required on each side of the dumbbell 1100 to provide eight different dumbbell loads, and the number of available dumbbell loads may be doubled by adding two "half-weights" which weigh two and one-half pounds each, for example. A suitable half-weight is designated as 1150 in FIGS. 73–74. The half-weight 1150 is generally similar in size and shape to the other weights 1131–1133, but one-half as thick as the five-pound weights 1133. The half-weight 1150 is provided with a slot 1151 which is sized and configured to receive the handle 1110. Hook-type fasteners 1152 are provided on one side of the half-weight 1150 to facilitate connection of the half-weight 1150 to loop type fasteners 1125 on either inner wall 1122 (when the half-weight 1150 is inverted relative to the other weights 1131–1133). Each inner wall 1122 creates a gap between the sides of a half-weight 1150 and the sides of a respective twenty-pound weight 1131, to facilitate removal of the half-weight 1150 from the inner wall 1122.

Another optional feature on the embodiment 1100 is the provision of dust covers shown in dotted lines and designated as 1128. Each dust cover 1128 is rigidly connected to a respective weight support 1120 and spans the weights 1131–1133 and the walls 1122 and 1124 on a respective side of the dumbbell 1100. In the alternative, the dust covers 1128 may be connected to the weight supports 1120 by snap fit or releasable fasteners, such as hook and loop fasteners.

Another dumbbell constructed according to the principles of the present invention is designated as 100 and described with reference to FIGS. 1–8. The dumbbell 100 includes a parallelepiped block 110, which is preferably one or two pieces of injection molded plastic. A central opening 112, bounded by opposing end walls 111, is provided in the block 110 to receive and accommodate a person's hand. A cylindrical handle 120 is disposed within the opening 112 and extends perpendicularly between the end walls 111. The handle 120 has an outer diameter of about one inch and is sized and configured to be grasped.

Eight slots 114 are provided in the block 110 to receive and accommodate weights 140*a* and 140*b*. Each slot 114 is sized and configured to receive up to five one-pound weights 140*a* or one five-pound weight 140*b*. In other words, up to forty pounds of weights 140*a* and 140*b* may be inserted into the block 110.

Figure 6:
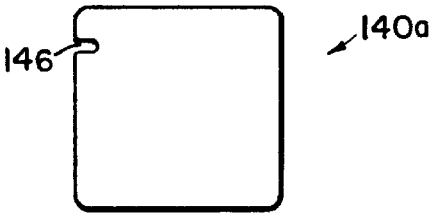
FIG. 6 is an end view of one of the weights of FIG. 4.

FIG. 6 shows an end view of one of the weights 140*a*. The weight 140*a* is a twelve gauge steel plate approximately six inches wide and six inches high (the weights 140*b* present the same end view and are five times as thick). A notch 146 is provided in the weight 140*a* to accommodate a latch or selector rod 160, as further explained below. The sidewalls of the notch 146 may be made outwardly divergent in order to facilitate insertion of the latch 160 into the notch 146.

Figure 1:
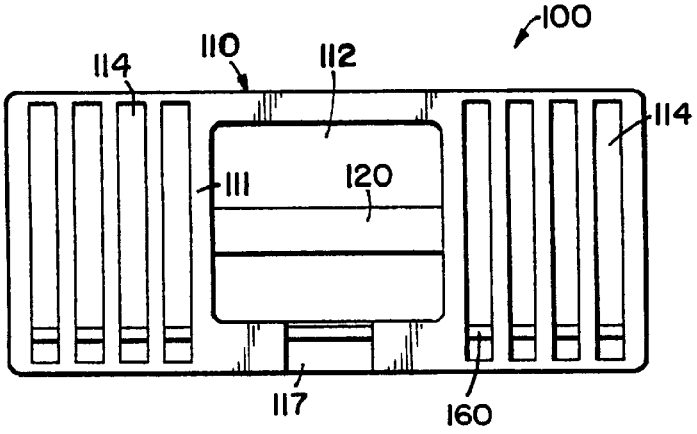
FIG. 1 is a top view of a first exercise dumbbell constructed according to the principles of the present invention.
Figure 2:
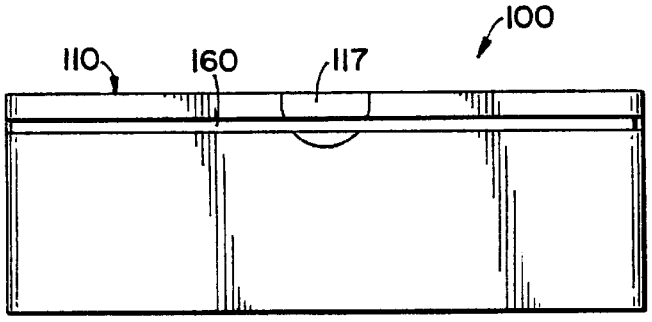
FIG. 2 is a front view of the dumbbell of FIG. 1.
Figure 3:
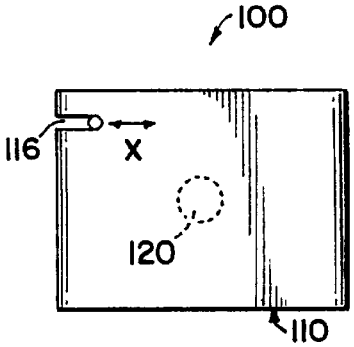
FIG. 3 is an end view of the dumbbell of FIG. 1.
Figure 4:
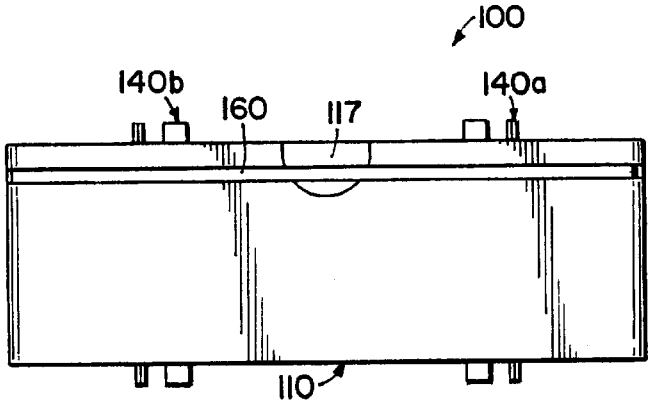
FIG. 4 is a front view of the dumbbell of FIG. 1 with a plurality of weights connected thereto.

FIG. 3 shows an end view of the block 110. A longitudinal notch 116 is provided in the block 110 to align with the notch 146 in the weight 140*a* and likewise accommodate the latch 160. This notch may be provided with outwardly divergent sidewalls, as well. A transverse notch 117 is provided in the block 110 to facilitate operation of the latch 160 as further explained below.

Figure 5:
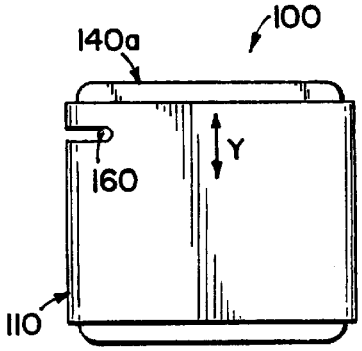
FIG. 5 is an end view of the dumbbell and weights of FIG. 4.
Figure 7:
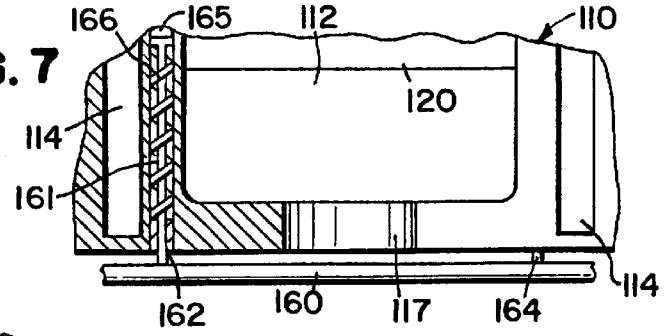
FIG. 7 is an enlarged and partially sectioned top view of a portion of the dumbbell of FIG. 1 with a latch portion occupying a discrete position relative to the remainder of the dumbbell.

As indicated by the arrows in FIG. 3, the latch 160 is movable in the direction X relative to the block 110. As shown in FIG. 7, the latch is movable (in the direction X) to a position outside the confines or planform of the block 110. When the latch 160 occupies the "open" position shown in FIG. 7, the weight 140*a* is freely movable in the direction Y (shown in FIG. 5) relative to the block 110. FIG. 5 shows the relative positions of the weights 140*a* and 140*b* and the block 110 when the notches 116 and 146 are aligned to receive the latch 160. When the weights 140*a* and 140*b* are latched in place, the longitudinal axis of the handle 120 is generally aligned with the inertia centers of the weights 140*a* and 140*b*.

When the latch 160 occupies the "closed" position shown in FIG. 5, the weight 140*a* is latched against movement relative to the block 110 (in the direction Y or otherwise). In particular, the relatively longer walls of the slot 114 prevent the weight 140*a* from moving axially relative to the handle 120; and the relatively shorter walls of the slot 114 prevent the weight 140*a* from moving in the radial direction X; and the latch 160 (along with the opposite, relatively shorter wall of the slot 114) prevents the weight 140*a* from moving in the radial direction Y.

FIG. 7 shows how the latch 160 is movably connected to the block 110. A cylindrical opening or bore 161 is provided in each of the end walls 111 of the block 110 to receive a respective shaft 164. Each shaft 164 has a first end connected to the latch 160 and a second, opposite end having a relatively large diameter head 165. A helical spring 166 is mounted on each shaft 164 and compressed between the head 165 and a plug 162 which inserts into the proximate end of the opening 161 to secure the spring 166 and the head 165 therein. The spring 166 biases the latch 160 toward the notches 116 and 146 and the closed position shown in FIG. 5. The spring 166 acts in the direction X, perpendicular to the direction Y, and thus, is not subject to gravitational force acting on the weight 140*a*.

The notch 117 enables a person to "reach behind" the latch 160 and pull it toward the open position shown in FIG. 7. The relative sizes of the weights 140*a* and 140*b* and the block 110 are such that the block 110 may be pushed downward relative to the weights 140*a* and 140*b* to temporarily secure the latch 160 in the open position (bearing against the outside edges of the weights 140*a* and 140*b*). Subsequent upward movement of the block 110 relative to the weights 140*a* and 140*b* and/or downward movement of the weights 140*a* and 140*b* relative to the block 110 will cause the latch 160 to snap into the notches 116 and 146.

Figure 8:
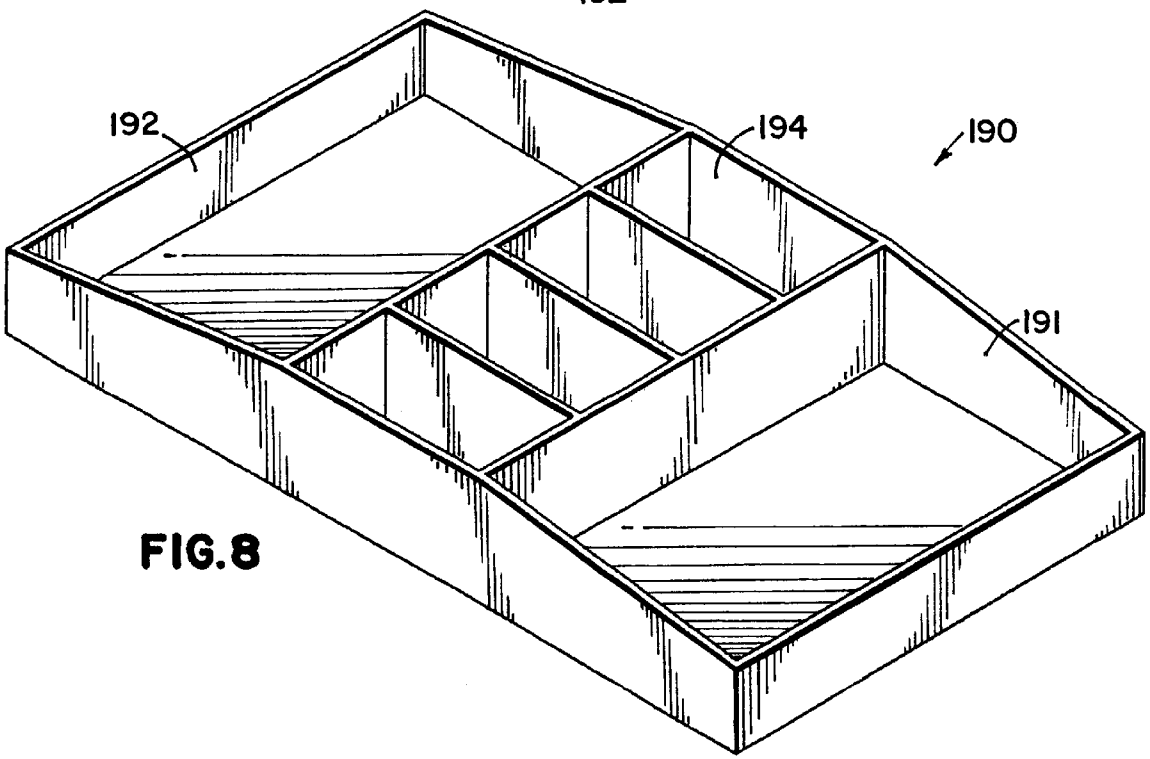
FIG. 8 is a perspective view of a base sized and configured to support two of the dumbbells of FIG. 1 and the weights of FIG. 4.

FIG. 8 shows a base or housing 190 which is sized and configured to receive two of the dumbbells 100 and up to eighty pounds of weights 140*a* and 140*b*. A first compartment 191 is provided for a first dumbbell 100, and a second compartment 192 is provided for a second dumbbell 100. Each of four compartments 194 is sized and configured to receive and accommodate twenty pounds of weights 140*a* and 140*b*. On one contemplated embodiment, twenty one-pound weights 140*a* and twelve five-pound weights 140*b* are provided together with two blocks 110 and one base 190. Assuming that each block 110 weighs three pounds, this arrangement provides two dumbbells 100 which may be adjusted between three and forty-three pounds in one pound increments.

Among other things, those skilled in the art will recognize that the dumbbell 100 and/or the base 190 provide convenient and reliable means for holding the weights in place prior to selection; changing the amount of weight engaged for exercise motion; supporting the weights during exercise motion; and/or returning the weights to their proper location at the conclusion of exercise motion.

Some additional variations of the present invention are embodied on the dumbbell designated as 200 and described with reference to FIGS. 9–13. The dumbbell 200 similarly includes a block-shaped member 210, which is preferably one or two pieces of injection molded plastic. A central opening 212 is provided in the block 210 to receive and accommodate a person's hand. The opening 212 is bounded by opposing end walls 211. A cylindrical handle 220 is disposed within the opening 212 and extends perpendicularly between the end walls 211.

Eight upwardly opening slots or compartments 214 are provided in the block 210 to receive and accommodate weights 240*a* and 240*b*. The compartments 214 are bounded by a bottom wall 219, and the handle 220 is positioned to align more with the centers of inertia of the weights 240*a* and 240*b* within the compartments 214 than with the geometric center of the end walls 211 on the block 210. The compartments are bounded by flanges 213 rather than continuous intermediate walls. One compartment 214 on each side of the block 210 is sized and configured to receive one ten-pound weight 240*b*, and the other three compartments 214 on each side of the block 210 are sized and configured to receive up to five one-pound weights 240*a* or one five-pound weight. In other words, up to fifty pounds of weights 240*a* and 240*b* may be inserted into the block 210.

The weight 240*a* is a twelve gauge steel plate approximately six inches wide and six inches high (the weights 240*b* are similar in shape but ten times as thick). Like on the first dumbbell weights 140*a* and 140*b*, a notch is provided in each weight 240*a* and 240*b* to accommodate a latch or selector rod 260, as further explained below. In addition, a hemispherical opening 245 is provided in each weight 240*a* and 240*b* to facilitate handling of the weights 240*a* and 240*b*.

Figures 9, 10, 11, 12, 13:
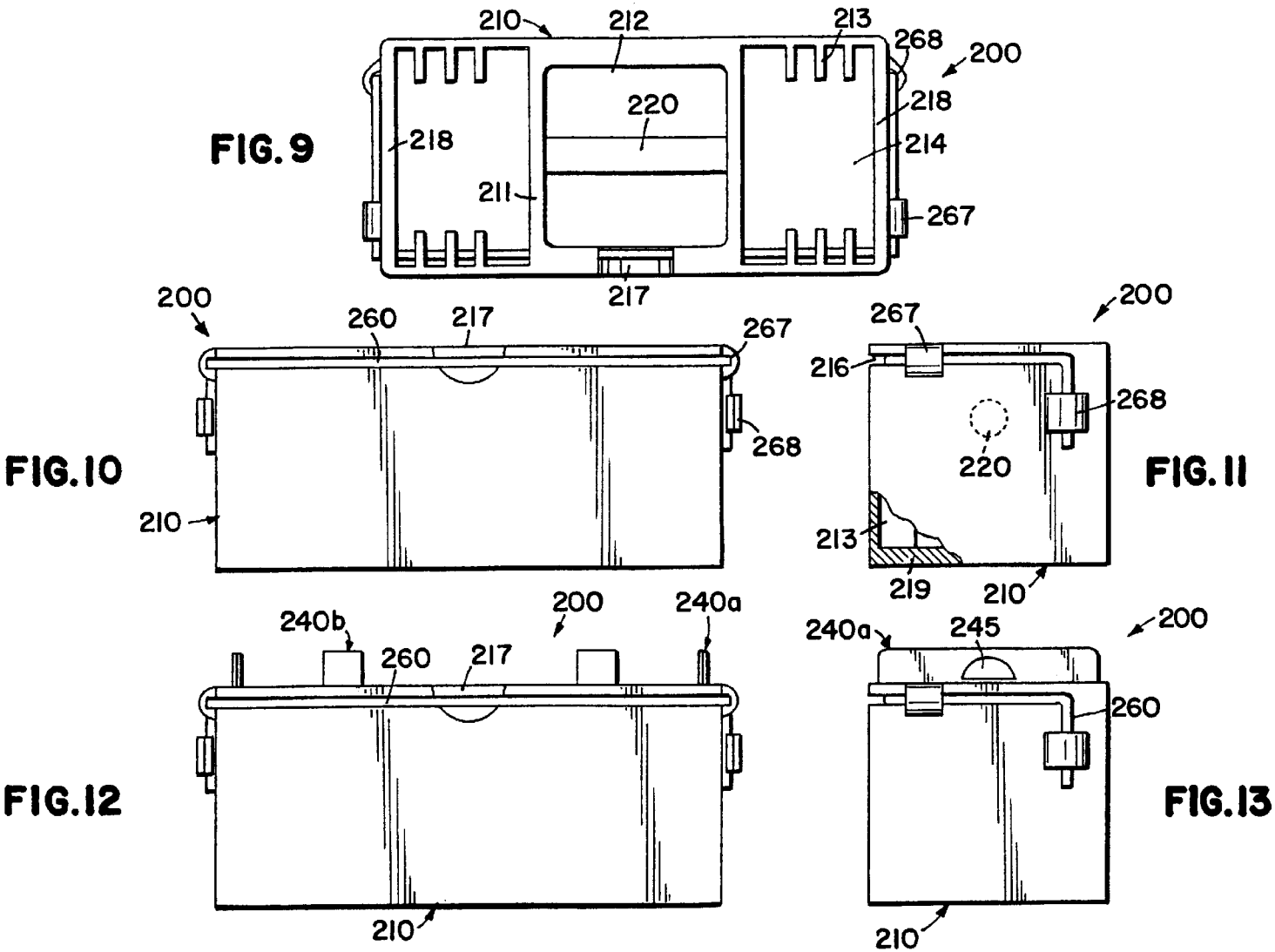
FIG. 9 is a top view of a second exercise dumbbell constructed according to the principles of the present invention.
FIG. 10 is a front view of the dumbbell of FIG. 9.
FIG. 11 is a partially sectioned end view of the dumbbell of FIG. 9.
FIG. 12 is a front view of the dumbbell of FIG. 9 with a plurality of weights connected thereto.
FIG. 13 is an end view of the dumbbell and weights of FIG. 12.
Figure 14:
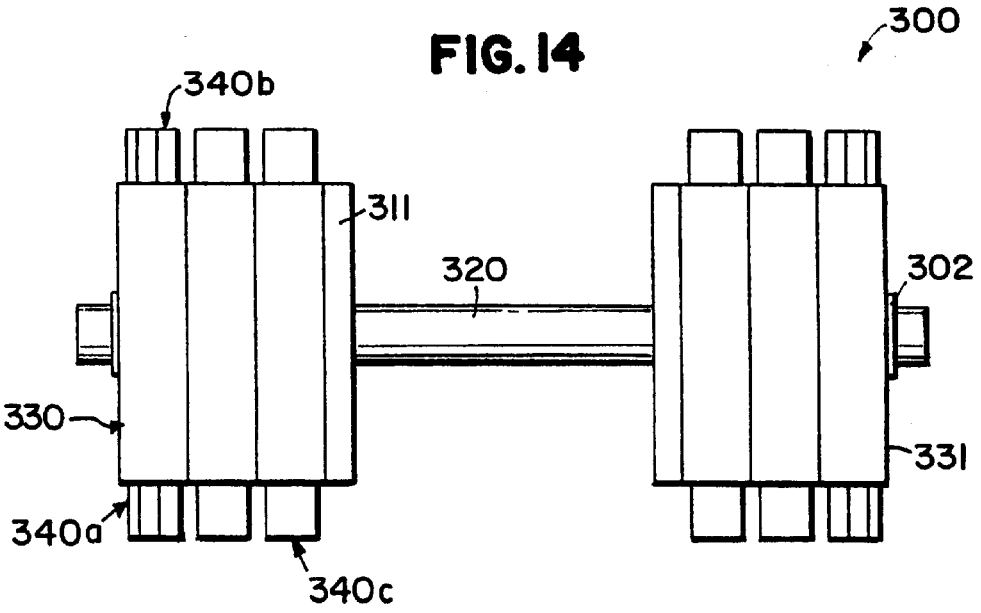
FIG. 14 is a front view of a third exercise dumbbell constructed according to the principles of the present invention.
Figure 15:
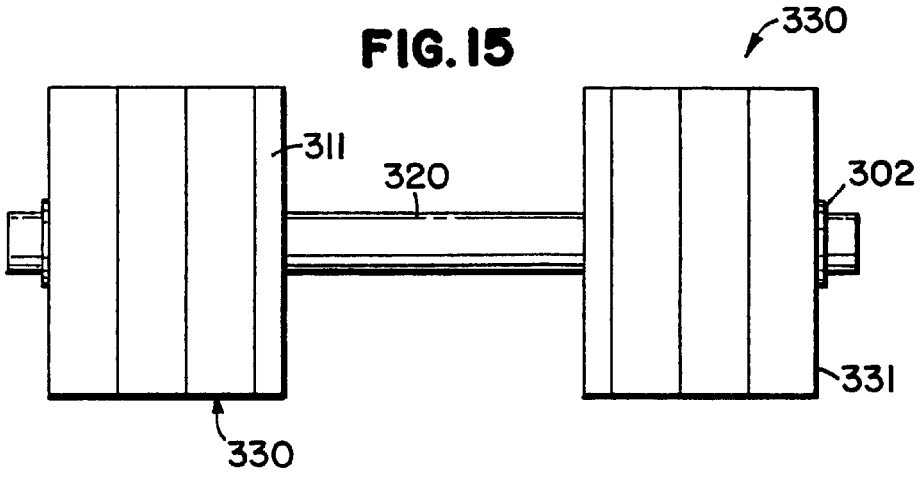
FIG. 15 is a front view of the dumbbell of FIG. 14 with the weights removed.

FIG. 11 shows an end view of the block 210. A notch 216 is provided in the block 210 to align with the notches in the weights 240*a* and 240*b* and likewise accommodate the latch 260. A discrete notch 217 is provided in the block 210 to facilitate manipulation of the latch 260, as further explained below.

As in the case of the foregoing embodiment 100, the latch 260 is movable in a first, horizontal direction relative to the block 210 (with reference to the upright orientations shown in FIGS. 10–13). The latch 260 is movable between an open position, outside the planform of the block 210, and a closed position, shown in FIGS. 11 and 13. When the latch 260 occupies the open position, the weights 240*a* and 240*b* are movable in a second, vertical direction relative to the block 210. FIG. 13 shows the relative positions of the weights 240*a* and 240*b* and the block 210 when the notches are aligned to receive the latch 260. When the latch 260 occupies the closed position, the weights 240*a* and 240*b* are latched against movement relative to the block 110 (in any direction).

The latch 260 includes a middle portion which selectively occupies the notch 216, opposite outside portions which extend perpendicularly away from the middle portion and overlie opposite outside walls 218 of the block 210, and opposite distal portions which extend perpendicularly away from respective outside portions and toward the bottom wall 219. The outside portions are slidably mounted to respective outside walls 218 by means of sleeve members 267, and the distal portions snap into and out of engagement with resilient clip members 268. The clip members 268 releasably retain the latch 260 in the closed position inside the notch 116. The arrangement is such that the clip members 268 are not subject to gravitational force acting on the weights 240*a* and 240*b*. Like on the dumbbell 100, the notch 217 enables a person to "reach behind" the latch 260 and pull it toward the open position.

A base or housing similar to that shown in FIG. 8 may be provided for two of the dumbbells 200 and up to one hundred pounds of weights. On one contemplated embodiment, the base is sized and configured to receive and accommodate twenty one-pound weights 240*a*, eight five-pound weights (not shown), and four ten-pound weights 240*b*. Assuming that each block 210 weighs three pounds, this arrangement provides two dumbbells 200 which may be adjusted between three and fifty-three pounds in one pound increments.

Among other things, those skilled in the art will recognize that the dumbbell 200 provides convenient and reliable means for enclosing the weights during exercise motion, as well as holding the weights in place prior to selection; changing the amount of weight engaged for exercise motion; supporting the weights during exercise motion; and/or returning the weights to their proper location at the conclusion of exercise motion.

Figure 16:
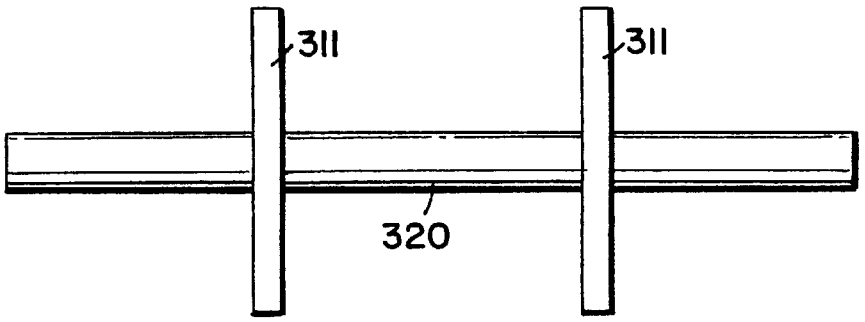
FIG. 16 is a front view of the dumbbell of FIG. 14 with the weights and the weight supports removed.

Additional variations of the present invention are embodied on a dumbbell designated as 300 and described with reference to FIGS. 14–21. As shown in FIG. 16, the dumbbell 300 has a cylindrical bar 320 which is approximately sixteen inches long and one inch in diameter. Rigid plates 311 are secured to the bar 320 at locations about six inches apart from one another, thereby defining an intermediate handle portion and opposite distal portions.

Three weight supports or housings 330 are mounted on each of the distal portions of the bar 320, adjacent a respective plate 311. As shown in FIGS. 17–19, each housing 330 has a rectangular end wall 331 and opposite side walls or shoulders 337. A hole 332 is formed through the end wall 331 to receive the bar 320, and each housing 330 is mounted on the bar 320 in such a manner that the end wall 331 is relatively distant from the plates 311. The plates 311 have the same rectangular shape as the end walls 331.

The innermost housing 330 on each side of the bar 320 cooperates with a respective plate 311 to define a weight compartment or slot. The intermediate housing 330 on each side of the bar 320 cooperates with the end wall 331 of a respective innermost housing 330 to likewise define a weight compartment or slot. Similarly, the outermost housing 330 on each side of the bar 320 cooperates with the end wall 331 of a respective intermediate housing 330 to likewise define a weight compartment or slot. Posts 338 on the housings 330 cooperate with holes 339 in adjacent housings 330 and the plates 311 to maintain alignment and facilitate interconnection of the parts. A fastener 302 is fixedly mounted on each end of the bar 320 to prevent axial movement of the housings 330 relative to the bar 320.

Leaf springs 334 are provided on opposite sides of the housing 330. The leaf springs 334 may be described as inwardly convex and/or as having inwardly projecting portions 335 which are generally arcuate in shape. As further explained below, the leaf springs 334 perform both the latching and biasing functions which required discrete components on the previous embodiments. Openings 336 are provided in the end wall 331 to facilitate injection molding process which makes the housings 330.

Each compartment on the dumbbell 300 is sized and configured to receive up to five pounds of weight, for example. In this regard, each compartment may support five one-pound weights 340*a*, or two two-pound weights 340*b* and one one-pound weight 340*a*, or one five-pound weight 340*c*. In other words, up to thirty pounds of weights 340*a*–340*c* may be inserted into the compartments on the dumbbell 300. A base similar to that shown in FIG. 8 may be provided for two of the dumbbells 300 and up to sixty pounds of weights. On one contemplated embodiment, the base is sized and configured to receive and accommodate four one-pound weights 340*a*, eight two-pound weights 340*b*, and eight five-pound weights 340*c*. Assuming that each "empty" dumbbell 300 weighs three pounds, this arrangement provides two dumbbells 300 which may be adjusted between three and thirty-three pounds in one pound increments.

Figure 20:
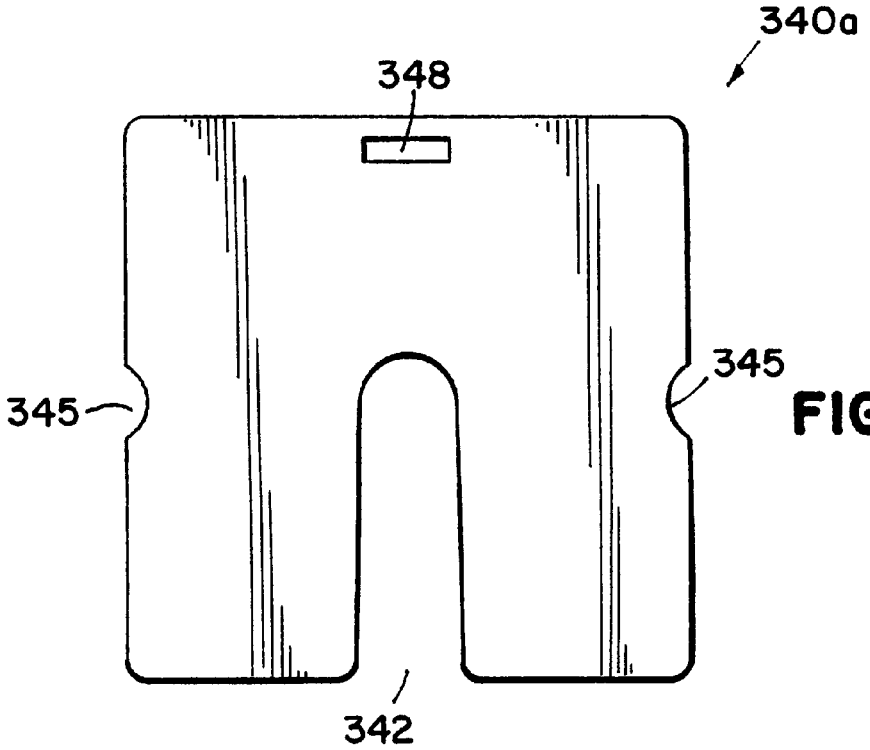
FIG. 20 is an end view of one of the weights on the dumbbell of FIG. 14.

The weight 340*a* is a twelve gauge steel plate approximately six inches wide and seven inches high (the weights 240*b* are similar in shape but twice as thick, and the weights 240*c* are similar in shape but five times as thick). As shown in FIG. 20, a relatively deep, central notch 342 is provided in each weight 340*a*–340*c* to accommodate or provide clearance for the bar 320. Relatively shallow, arcuate notches 345 are provided in opposite sides of each weight 340*a*–340*c* to interact with the arcuate portions 335 of the leaf springs 334. In particular, as the weight 340*a* is inserted into a compartment, the peripheral edges of the weight 340*a* encounter the opposing leaf springs 334 and force the latter away from one another. When the arcuate portions 335 of the leaf springs 334 encounter the notches 345, the former snap toward one another and into the latter to bias the weight 340*a* against further movement relative to the housing 330.

The weights 340*a*–340*c* may be removed from the compartments by pushing the assembly downward against a floor surface. Under such circumstances, the weights 340*a*–340*c* press against the floor and thus, are subjected to an upward force equal in magnitude to the downward force. When the force is sufficient to overcome the biasing effect of the leaf springs 334, the arcuate portions 335 deflect away from one another and out of the notches 345. Once the arcuate portions 335 are bearing against the linear edges of the weights 340*a*–340*c*, the leaf springs 334 offer little resistance to removal of the weights 340*a*–340*c*.

Figure 21:
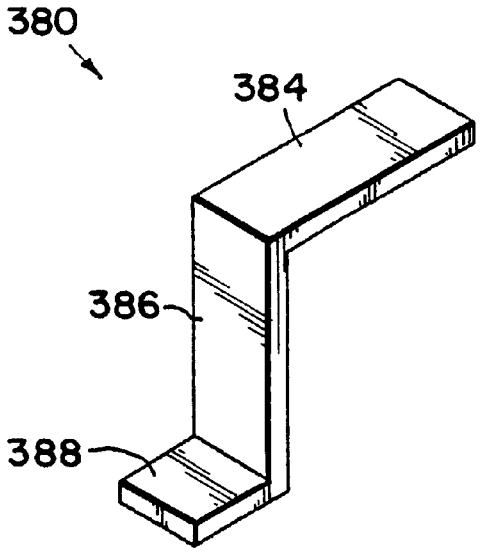
FIG. 21 is a perspective view of an optional tool suitable for use together with the dumbbell of FIG. 14.

An alternative method of removing the weights 340*a*–340*c* from the compartments may be described with reference to an optional opening 348 shown in the weight 340*a* in FIG. 20 and an optional tool 380 shown in FIG. 21. The tool 380 has a first distal portion 384 sized and configured for grasping, an intermediate portion or offset 386, and a second distal portion 388 sized and configured to insert into the opening 348 in the weight 340*a*. The tool 380 essentially allows a user to "grab" any of the weights 340*a*–340*c* and exert a sufficiently large pulling force to extract same from a weight housing 330.

Among other things, those skilled in the art will recognize that the dumbbell 300 provides convenient and reliable means for holding the weights in place prior to selection; changing the amount of weight engaged for exercise motion; supporting the weights during exercise motion; and/or returning the weights to their proper location at the conclusion of exercise motion.

Still more variations of the present invention are embodied on a dumbbell designated as 400 and described with reference to FIGS. 22–29. The dumbbell 400 generally includes a handle assembly 410, a plurality of weights 440*a*–440*h* which are selectively connected to the handle assembly 410, and a base 490 which supports any of the weights 440*a*–440*h* that are not connected to the handle assembly 410.

The handle assembly 410 includes first and second plates 411 which are oval in shape. The plates 411 are rigidly secured to a cylindrical bar 420 at discrete locations spaced about six inches apart from one another. The bar 420 has an outside diameter of approximately one inch and is approximately sixteen inches long. The plates 411 cooperate with the bar 420 to define an intermediate bar portion which is sized and configured for grasping, as well as opposite distal ends of the bar 420. A rod 418 is rigidly secured between the plates 411 for reasons explained below.

A latch 430 is movably connected to the plates 411. The latch 430 may be described as equal in length to the bar 420 and extending parallel thereto. Optional end plates, similar in size and shape to the plates 411, for example, may be secured to the opposite, distal ends of the bar 420 to eliminate any perceived or potential hazard posed by protruding ends. The latch 430 moves within generally L-shaped slots 413 in the plates 411 (primarily in the radial direction designated as Y in FIG. 24). The latch 430 is movable between a "closed" position, shown in FIGS. 22–23, and an "open" position, shown in FIGS. 24–25, as more fully explained below.

The handle assembly 410 further includes a means for locking the latch 430 in either position relative to the plates 411. In particular, a relatively long tube 432 is movably mounted on the latch 430 between the plates 411. One end of the tube 432 has a relatively larger inside diameter which is bounded axially by a shoulder or rim 434. A relatively smaller tubular member 436 is mounted on the latch 430 proximate the larger diameter end of the long tube 432. A helical spring 438 is disposed within the larger diameter end of the tube 432 and compressed between the member 436 and the rim 434. The spring 438 biases the tube 432 away from the member 436.

A peg 439 projects from an opposite end of the tube 432 and parallel to the latch 430. As shown in FIG. 23, the peg 439 inserts into a first, radially inward hole in the plate 411 to secure or lock the latch 430 in the closed position. As shown in FIG. 25, the peg 439 inserts into a second, radially outward hole in the plate 411 to secure or lock the latch 430 in the open position. Movement of the tube 432 against the force of the spring 438 and toward the member 436 unlocks the latch 430 and allows it to be moved between the open position and the closed position. In other words, the latch 430 moves in a first, radial direction Y between a closed position and an open position, and the tube 432 moves in a second, axial direction X to lock and unlock the latch 430.

Each of the weights 440*a*–440*h* includes identical first and second plates 444, and a respective connector rod 446*a*–446*h* rigidly interconnected therebetween. Each plate 444 may be described as disc-shaped and includes a first, relatively large notch 442 to receive and accommodate the handle bar 420, and a second, generally L-shaped notch 443 which coincides in size and shape with a portion of the slots 413 in the plates 411.

The rod 446*a* is relatively short, and the weight 440*a* is disposed between the plates 444 on the other weights 440*b*–440*h*. The rod 446*h* is relatively long, and the plates 444 on the weight 440*h* are disposed outside the other weights 440*a*–440*g*. The rods 446*b*–446*g* and the plates 444 on the weights 440*b*–440*g* fall in between these two extremes.

The weights 440*a*–440*h* are supported by a base 490 when not carried away on the handle assembly 410. The base 490 has a flat bottom surface 492 and an arcuate top surface 494. The top surface 494 coincides with the lower periphery of the plates 411 and 444 and supports same in cup-like fashion. The base 490 has opposing side walls or surfaces 496 and 498 which extend in convergent fashion from opposite edges of the bottom surface 492 to opposite edges of the top surface 494. The side walls 496 and 498 cooperate with the rods 446*h* and 418, respectively, to maintain the weights 440*a*–440*h* and the handle assembly 410 in relative alignment. In particular, when the rods 446*h* and 418 abut respective side walls 496 and 498, the slots 413 in the plates 411 are disposed within the confines of the notches 442 in the plates 444 on the weight 440*h*. The same is true for each of the other weights 440*a*–440*g* having a respective rod 446*a*–446*g* rotated as far as possible toward the side wall 496.

A peg or stop 416 is provided on each of the plates 411 to facilitate alignment of the notches 443 relative to the slots 413. The pegs 416 project toward one another from respective plates 411 at a radial distance from the bar 420 equal to the radial distance between the rods 440*a*–440*h* and the bar 420. As a result, the rod 446*a* encounters the pegs 416 as the weight 440*a* is rotated relative to the handle assembly 410 and away from the surface 496 on the base 490. When the rod 446*a* abuts the pegs 416, the notches 443 in the plates 444 on the weight 440*a* align with the slots 413 in the plates 411, thereby allowing the latch 430 to occupy the radially inward ends of the notches 443, as well as the radially inward ends of the slots 413.

The present invention may also be described in terms of various methods of adjusting resistance to exercise, based upon one or more of the foregoing embodiments. For example, one such method involves providing a handle assembly with a movable selector rod; maintaining weight plates in spaced relationship relative to the handle assembly; moving the selector rod out of a weight engagement position; effecting an alignment change between the selector rod and the weight plates; and moving the selector rod back into the weight engagement position to engage a desired number of the weight plates, as determined by alignment of the selector rod relative to the weight plates. Recognizing that the weights plates are provided at each end of the handle assembly, the method may provide a selector rod at each end of the handle assembly. Under such circumstances, a user is not required to engage the same number or combination of weight plates at each end of the handle assembly. The independent selection at each end of the handle assembly facilitates adjustments by one-half as much weight, but sacrifices balance in the process.

The present invention may be also be said to provide method of adjusting resistance to exercise, comprising the steps of providing a handle assembly with a longitudinal axis and a movable selector rod; providing a plurality of weight plates in axially spaced relationship relative to the handle assembly; and without interrupting the axially spaced relationship between the weight plates and the handle assembly, effecting a change in relative spatial relationship between the selector rod and the weight plates to latch any combination of the weight plates to the handle assembly.

The present invention may also be said to provide a method of adjusting resistance to exercise, comprising the steps of providing a handle assembly with a movable selector rod; providing a first weight next to the handle assembly; providing a second weight next to the first weight; selectively maneuvering the selector rod to secure only the first weight to the handle assembly; and selectively maneuvering the selector rod to secure only the second weight to the handle assembly.

From yet another perspective, the present invention may described in terms of a method involving the provision of a base sized and configured to support a plurality of weights in either of two positions; the provision of a handle assembly with a handle bar and a movable latch; the selective movement of a desired number of the weights to an "engageable" position relative to the base; and movement of the latch into engagement with the weights occupying the "engageable" position. In the alternative, the weights may remain stationary, and the selector rod may be moved to engage a different number of weights. In any of these methods, a further step may involve providing a biasing force and/or a structural interconnection which encourages the latch and the weights to remain interengaged.

Figure 26:
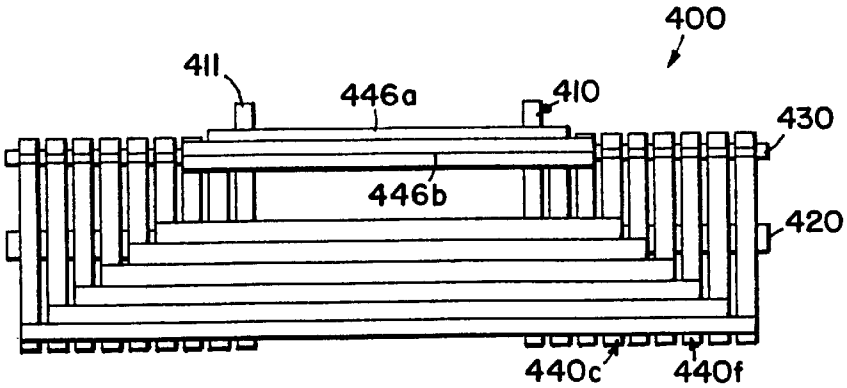
FIG. 26 is a front view of the dumbbell of FIG. 25.
Figure 27:
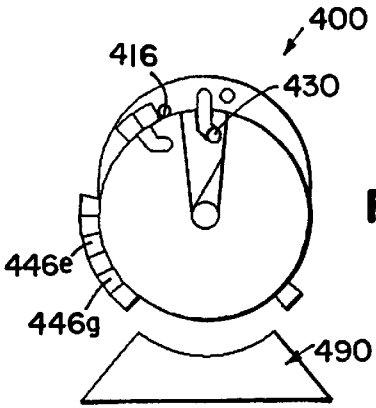
FIG. 27 is an end view of the dumbbell of FIG. 22, shown in a third selective configuration and relative to the underlying base first shown in FIG. 23.
Figure 28:
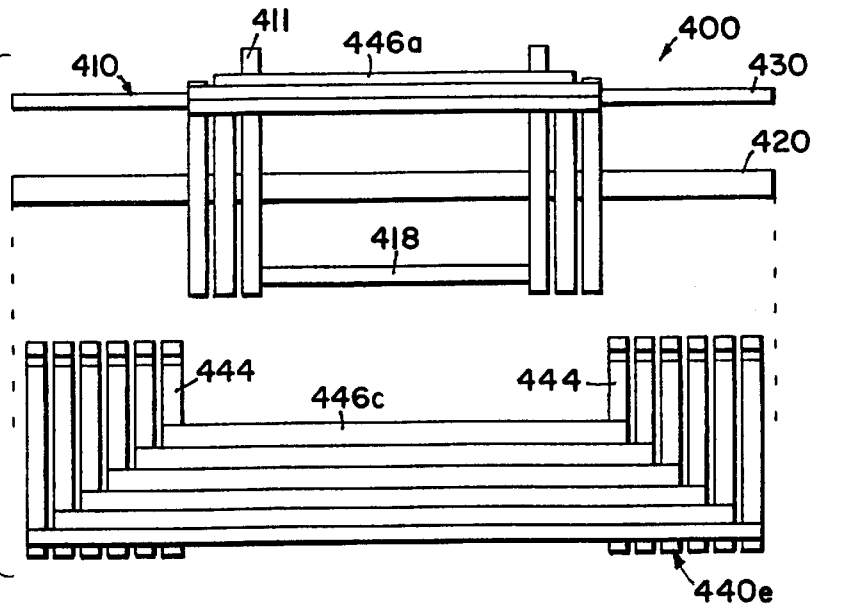
FIG. 28 is a front view of the dumbbell of FIG. 22, shown in an operative configuration with two discretionary weights connected to the handle assembly.
Figure 29:
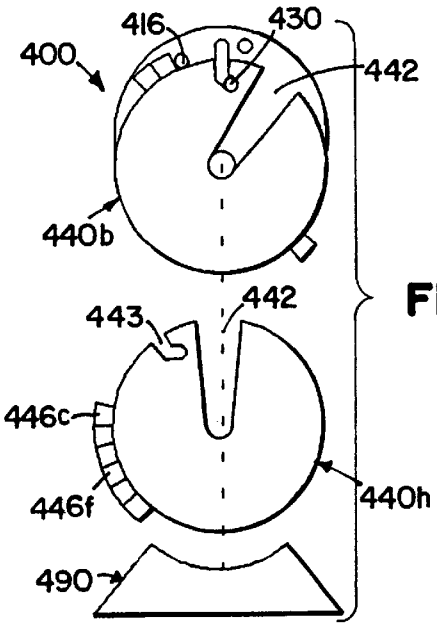
FIG. 29 is an end view of the dumbbell of FIG. 28, shown relative to the underlying base first shown in FIG. 23.
Figure 30:
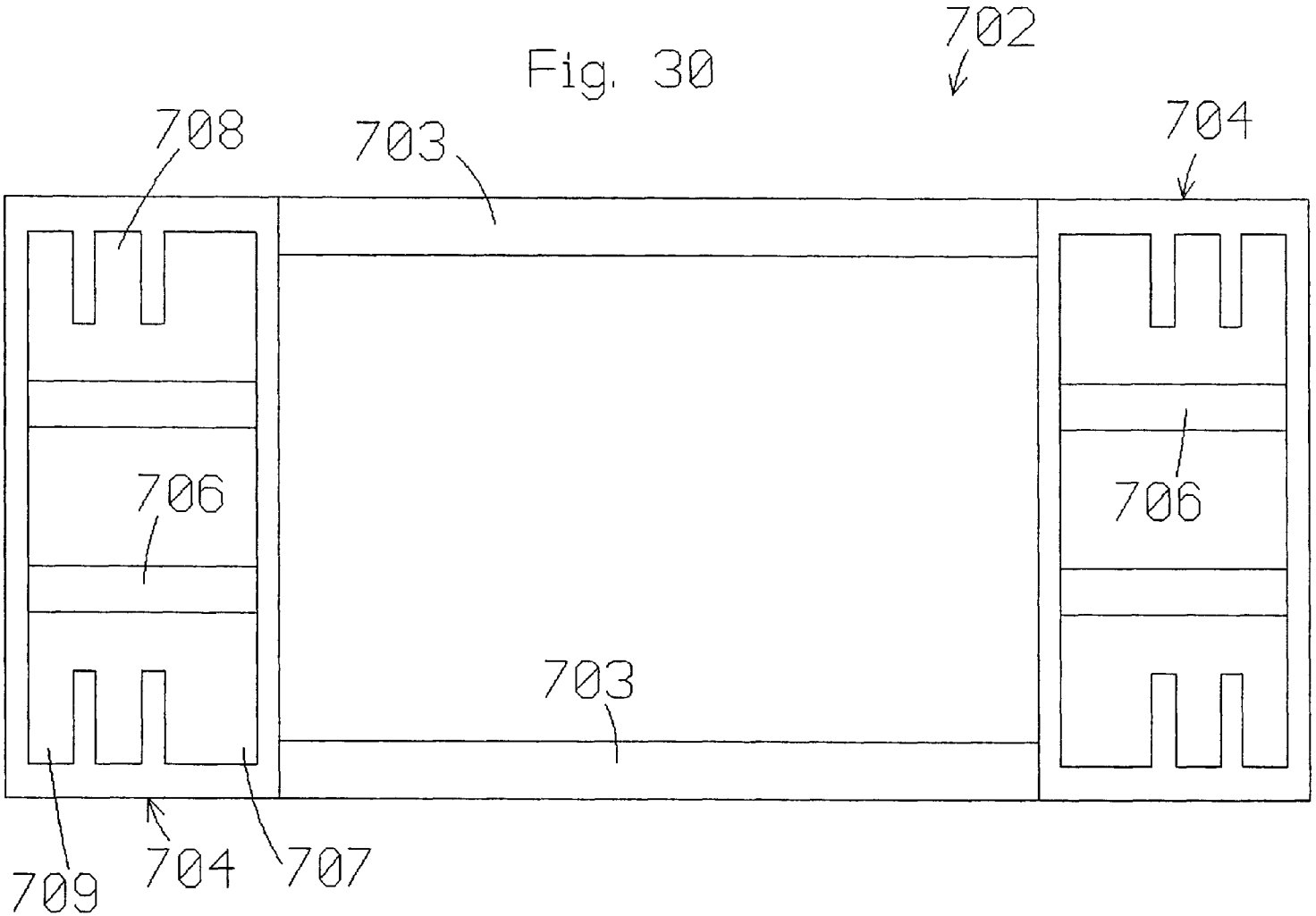
FIG. 30 is a partially sectioned side view of a cradle suitable for use with the preferred embodiment dumbbell first shown in FIG. 31.

Various stages of the foregoing method are illustrated with reference to the dumbbell 400, for example. In FIGS. 22–23, the latch 430 occupies the closed position relative to the plates 411 and is locked in that position by the peg 439. In FIG. 24, the latch 430 is locked in the open position, and the weights 440*a*–440*h* are free to rotate relative to the handle assembly 410 and/or the base 490. In FIGS. 25–26, the first two weights 440*a*–440*b* are shown rotated toward the pegs 416 until their notches 443 align with the slots 413. In FIG. 27, the latch 430 again occupies the closed position and is locked in that position by the peg 439. In FIGS. 28–29, the handle assembly 410 and weights 440*a*–440*b* are moved away from the base 490 and the remaining "unselected" weights 440*c*–440*h*.

With reference to the dumbbell 400, further method steps may include, for example, maintaining each of the plates 444 a fixed distance from the handle assembly 410 and/or adjacent plates 411 and 444. In this regard, spacers may be provided on the handle assembly 410 and/or on the plates 444 themselves. Methods and/or method steps may also be described with reference to additional and/or other embodiments described above. For example, the present invention discloses a method of providing adjustable resistance to exercise involving the steps of disposing weights on opposite sides of a handle; supporting a desired number of weights against movement in a first direction relative to the handle; and applying a biasing force in a second, orthogonal direction to maintain the support for the weights.

Yet another possible variation is to arrange a plurality of loose weight plates in a row; move the desired number of plates upward relative to the remainder so that holes through the displaced plates align with holes in plates on a handle assembly; and insert a rod through the aligned holes to connect the displaced plates to the handle assembly. Moreover, clips may be used to connect multiple weight plates or weight housings to build weight modules which, in turn, may be selectively connected to a handle assembly or within compartments on a handle assembly.

Recognizing that aspects of various methods and/or embodiments of the present invention may be mixed and matched in numerous ways to arrive at additional variations of the present invention, and that this disclosure is likely to lead those skilled in the art to derive still more variations, the scope of the present invention is to be limited only to the extent of the following claims.

What is claimed is:

1. A method of adjusting resistance to exercise, comprising the steps of:

providing a handle assembly with a handle having a longitudinal axis, and a movable selector rod that extends parallel to the axis;

maintaining weight plates in respective, axially aligned positions to the handle;

moving the selector rod axially out of a weight engagement position;

effecting an alignment change between the selector rod and at least one of the weight plates; and moving the selector rod axially back into the weight engagement position to engage a desired number of the weight plates, as determined by alignment of the selector rod relative to the weight plates.

2. The method of claim 1, further comprising the step of biasing the selector rod to remain in the weight engagement position.

3. The method of claim 1, wherein each of the weight plates is provided with an upwardly opening slot which is sized and configured to receive a bar on the handle assembly.

4. The method of claim 1, wherein each of the weight plates is sized and configured to fit within a respective compartment on the handle assembly.

5. The method of claim 1, wherein the weight plates are maintained in spaced relationship by spacers on the handle assembly.

6. The method of claim 1, wherein the change in alignment involves rotating the selector rod relative to the weight plates.

7. The method of claim 6, wherein the handle assembly has a longitudinal axis, and the selector rod is selectively rotated about the longitudinal axis.

8. The method of claim 1, wherein the weight plates are provided in such a manner that a second weight plate is disposed between a first weight plate and a third weight plate, and the selector rod is maneuverable into engagement with the first weight plate and the third weight plate without engaging the second weight plate.

9. The method of claim 1, wherein the weight plates are provided in such a manner that a first weight plate is disposed adjacent a second weight plate, and the selector rod is selectively maneuverable into engagement with the first weight plate without engaging the second weight plate, and the selector rod is selectively maneuverable into engagement with the second weight plate without engaging the first weight plate.

10. The method of claim 9, wherein the plates are further provided in such a manner that the selector rod is selectively maneuverable into engagement with both the first weight plate and the second weight plate contemporaneously.

11. A method of adjusting resistance to exercise, comprising the steps of:

providing a handle assembly with a longitudinal axis and a movable selector rod;

providing a plurality of weight plates in axially spaced relationship relative to the handle assembly; and without interrupting the axially spaced relationship between the weight plates and the handle assembly, effecting a change in relative spatial relationship between the selector rod and the weight plates to latch any combination of the weight plates to the handle assembly.

12. The method of claim 11, wherein the effecting step involves rotating the selector rod relative to the weight plates.

13. The method of claim 12, wherein the effecting step involves moving the selector rod axially relative to the weight plates before rotating the selector rod relative to the weight plates.

14. The method of claim 11, wherein the effecting step involves moving the selector rod away from the weight plates, realigning the selector rod relative to the weight plates, and moving the selector rod back toward the weight plates.

15. The method of claim 11, further comprising the step of biasing the selector rod to remain in a desired spatial relationship relative to the weight plates.

16. A method of adjusting resistance to exercise, comprising the steps of:

providing a handle assembly with a movable selector rod;

providing a first weight next to the handle assembly;

providing a second weight next to the first weight;

selectively maneuvering the selector rod to secure only the first weight to the handle assembly; and selectively maneuvering the selector rod to secure only the second weight to the handle assembly.

17. The method of claim 16, wherein the selector rod is also selectively maneuvered to secure both the first weight and the second weight to the handle assembly.

18. The method of claim 16, wherein the maneuvering step involves reorienting the selector rod relative to the handle assembly.

19. The method of claim 16, wherein the maneuvering step involves rotating the selector rod relative to the handle assembly.

20. The method of claim 19, wherein the maneuvering step involves moving the selector rod axially relative to the handle assembly before rotating the selector rod relative to the handle assembly.

* * * * *